US009640877B2

(12) United States Patent
Aoki et al.

(10) Patent No.: US 9,640,877 B2
(45) Date of Patent: May 2, 2017

(54) CONNECTION STRUCTURE OF CRIMP TERMINAL WITH RESPECT TO WIRE

(71) Applicant: YAZAKI CORPORATION, Tokyo (JP)

(72) Inventors: Hiroshi Aoki, Shizuoka (JP); Kazuto Ohtaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/007,424

(22) Filed: Jan. 27, 2016

(65) Prior Publication Data

US 2016/0141768 A1 May 19, 2016

Related U.S. Application Data

(63) Continuation of application No. PCT/JP2014/072852, filed on Aug. 26, 2014.

(30) Foreign Application Priority Data

Aug. 26, 2013 (JP) ..... 2013-174769
Aug. 26, 2013 (JP) ..... 2013-174829
(Continued)

(51) Int. Cl.
*H01R 4/18* (2006.01)
*H01R 4/62* (2006.01)
*H01R 13/52* (2006.01)

(52) U.S. Cl.
CPC ..... *H01R 4/185* (2013.01); *H01R 4/62* (2013.01); *H01R 13/52* (2013.01)

(58) Field of Classification Search
CPC ..... H01R 4/185; H01R 4/62; H01R 13/52
See application file for complete search history.

(56) References Cited

U.S. PATENT DOCUMENTS 5,157,853 A * 10/1992 Piana ..... G09F 3/06 40/316
8,607,449 B2 * 12/2013 Kitagawa ..... H01R 4/185 174/110 R
(Continued)

FOREIGN PATENT DOCUMENTS

CN 102812598 A 12/2012
CN 102823064 A 12/2012
(Continued)

OTHER PUBLICATIONS

International Search Report and Written Opinion of the International Search Report for PCT/JP2014/072852 dated Oct. 28, 2014.
(Continued)

*Primary Examiner* — Ross Gushi
(74) *Attorney, Agent, or Firm* — Kenealy Vaidya LLP

(57) ABSTRACT

Herein disclosed is a connection structure including a waterproof sheet disposed in an inner surface of a wire connection section and has an opening section in a position corresponding to a conductor exposed section, in which the waterproof sheet is configured such that a front end of the waterproof sheet is positioned on a front side from a front end of a conductor crimp section and a rear end of the waterproof sheet is positioned on a rear side from a rear end of the cover crimp section.

9 Claims, 22 Drawing Sheets

(30) Foreign Application Priority Data

| | | |
|---|---|---|
| Aug. 26, 2013 | (JP) | 2013-174830 |
| Mar. 19, 2014 | (JP) | 2014-057086 |
| Apr. 4, 2014 | (JP) | 2014-077836 |

(56) References Cited

U.S. PATENT DOCUMENTS

| | | | | |
|---|---|---|---|---|
| 8,641,461 | B2 * | 2/2014 | Mitose | H01R 4/185 439/587 |
| 8,771,015 | B2 * | 7/2014 | Inoue | H01R 4/70 439/604 |
| 8,834,213 | B2 * | 9/2014 | Sato | H01R 4/185 439/866 |
| 8,900,010 | B2 * | 12/2014 | Aoki | H01R 4/185 439/587 |
| 8,944,862 | B2 | 2/2015 | Sato | |
| 8,974,258 | B2 | 3/2015 | Mitose et al. | |
| 9,033,751 | B2 * | 5/2015 | Sato | H01R 4/188 439/877 |
| 9,099,792 | B2 | 8/2015 | Kondou et al. | |
| 9,172,151 | B2 * | 10/2015 | Sato | H01R 4/206 |
| 9,293,838 | B2 * | 3/2016 | Sakaguchi | H01R 4/62 |
| 9,318,815 | B2 * | 4/2016 | Mitose | H01R 4/183 |
| 9,350,109 | B2 * | 5/2016 | Ohnuma | H01R 4/184 |
| 2002/0027013 | A1 * | 3/2002 | Kondo | H01R 4/70 174/110 R |
| 2005/0095892 | A1 * | 5/2005 | Fukuyama | H01R 11/12 439/287 |
| 2005/0227549 | A1 * | 10/2005 | Takayama | H01R 4/185 439/851 |
| 2005/0227550 | A1 * | 10/2005 | Takayama | H01R 4/185 439/851 |
| 2012/0329317 | A1 | 12/2012 | Aoki et al. | |
| 2012/0329342 | A1 * | 12/2012 | Sato | H01R 4/184 439/866 |
| 2012/0329343 | A1 * | 12/2012 | Sato | H01R 4/185 439/866 |
| 2013/0005197 | A1 * | 1/2013 | Sato | H01R 4/188 439/741 |
| 2013/0040509 | A1 | 2/2013 | Mitose et al. | |
| 2013/0095708 | A1 | 4/2013 | Mitose et al. | |
| 2013/0130569 | A1 * | 5/2013 | Sato | H01R 4/206 439/882 |
| 2013/0292173 | A1 * | 11/2013 | Inoue | H01R 4/185 174/74 R |
| 2014/0004758 | A1 | 1/2014 | Kondou et al. | |
| 2014/0151083 | A1 * | 6/2014 | Ohnuma | H01R 4/184 174/93 |
| 2014/0224536 | A1 * | 8/2014 | Ito | H01R 4/184 174/84 C |
| 2014/0378009 | A1 * | 12/2014 | Yamada | H01R 4/187 439/865 |
| 2015/0011116 | A1 * | 1/2015 | Ohnuma | H01R 4/185 439/519 |
| 2015/0011117 | A1 * | 1/2015 | Ohnuma | H01R 4/185 439/520 |
| 2015/0017833 | A1 * | 1/2015 | Sato | H01R 4/184 439/519 |
| 2015/0021090 | A1 * | 1/2015 | Mano | H01R 4/185 174/72 A |
| 2015/0140202 | A1 * | 5/2015 | Sato | H01R 4/185 427/58 |
| 2015/0140856 | A1 * | 5/2015 | Sato | H01R 4/70 439/523 |
| 2015/0140874 | A1 * | 5/2015 | Sakaguchi | H01R 4/62 439/879 |
| 2015/0244133 | A1 * | 8/2015 | Hanazaki | H01R 4/184 174/74 R |
| 2015/0287496 | A1 * | 10/2015 | Sato | H01R 4/62 174/74 R |
| 2015/0318654 | A1 * | 11/2015 | Kawamura | H01R 43/048 439/877 |

FOREIGN PATENT DOCUMENTS

| | | | |
|---|---|---|---|
| CN | 102859795 | A | 1/2013 |
| EP | 2 533 364 | A1 | 12/2012 |
| JP | 2010-165514 | A | 7/2010 |
| JP | 2010-232119 | A | 10/2010 |
| JP | 2011-238465 | A | 11/2011 |
| JP | 2012-59671 | A | 3/2012 |
| JP | 2013-80682 | A | 5/2013 |
| JP | 2013-143323 | A | 7/2013 |
| WO | 2011/096526 | A1 | 8/2011 |
| WO | 2012/120770 | A1 | 9/2012 |

OTHER PUBLICATIONS

Japanese Office Action for the related Japanese Patent Application No. 2013-174829 dated Jan. 24, 2017.

Chinese Office Action and the Search Report for the related Chinese Patent Application No. 201480043184.8 dated Jan. 19, 2017.

* cited by examiner

CONNECTION STRUCTURE OF CRIMP TERMINAL WITH RESPECT TO WIRE

CROSS REFERENCE TO RELATED APPLICATIONS

This application is a continuation of PCT application No. PCT/JP2014/072852, which was filed on Aug. 26, 2014 based on Japanese patent applications No. 2013-174769 filed on Aug. 26, 2013, No. 2013-174829 filed on Aug. 26, 2013, No. 2013-174830 filed on Aug. 26, 2013, No. 2014-057086 filed on Mar. 19, 2014, and No. 2014-077836 filed on Apr. 4, 2014, whose contents are incorporated herein by reference. Also, all the references cited herein are incorporated as a whole.

BACKGROUND OF THE INVENTION

1. Technical Field

The present invention relates to a connection structure of a crimp terminal with respect to wire, with waterproof performance.

2. Background Art

Weight reduction of a vehicle significantly affects fuel economy improvement. At the present when reduction in carbon dioxide emissions is required, a wire made of a lightweight aluminum or an aluminum alloy is advantageously used in a wire harness, specifically in an electric vehicle or a hybrid vehicle in which the wire harnesses are used in large quantity compared to a gasoline vehicle. However, in a state where an aluminum wire configured of aluminum or an aluminum alloy is crimped and connected to a terminal configured of copper or a copper alloy, if water is interposed in a contact portion of the two, the water acts as an electrolytic solution between different kinds of metals. If different kinds of metals of the copper terminal and the aluminum conductor become an electrical circuit through the electrolytic solution, because of difference in corrosion potential of the two, corrosion of a metal (for example, aluminum conductor) of less noble potential is accelerated. That is, galvanic corrosion occurs.

Thus, a crimp terminal in which occurrence of electrolytic corrosion can be prevented while ensuring conductivity even if the crimp terminal is configured of different kinds of metals for the wire conductor that is crimped by a barrel piece is proposed (see JP-A-2013-80682).

An example of a connection structure of the crimp terminal with respect to the wire of the related art described in JP-A-2013-80682 is illustrated in FIGS. 20 to 22. In the drawings, a direction toward a counterpart terminal that is one side of the terminal in a longitudinal direction (consistent with a longitudinal direction of the wire) is referred to as forward, the opposite direction thereto is referred to as backward, a side on which the wire is mounted on the crimp terminal is referred to as upward, the opposite direction thereto is referred to as downward, one side and the other side of the terminal forward in a width direction are referred to as a left side and a right side, respectively.

As illustrated in FIG. 20, a crimp terminal 110 has a box section (electrical connection section) including a spring piece 112 for connecting to a mating male terminal in a front portion made of copper or a copper alloy and has a wire connection section 120 that is crimping an end portion of a wire W in which a conductor Wa is made of aluminum or an aluminum alloy in a rear portion thereof. The wire connection section 120 has a conductor crimp section 121 that is crimped onto a conductor exposed section Wap in which a cover Wb of the end portion of the wire W is removed and the conductor Wa is exposed in a position of the front side, and has a cover crimp section 122 that is crimped onto a portion to which the cover Wb remained in the end portion of the wire W is attached in a position of a rear side thereof.

The conductor crimp section 121 and the cover crimp section 122 have a common bottom plate section 125, and a pair of left and right common caulking pieces 126 and 127. The caulking pieces 126 and 127 are erected upward from left and right side edges of the common bottom plate section 125, and caulk the conductor exposed section Wap and the portion to which the cover Wb is attached by being bent inwardly so as to surround the conductor exposed section Wap and the portion to which the cover Wb is attached of the wire W that is to be connected in a state where the conductor exposed section Wap and the portion to which the cover Wb is attached come into pressed contact with an upper surface of the bottom plate section 125. The wire connection section 120 is formed having a cross section of a U shape that is continuous from a front end of the conductor crimp section 121 to a rear end of the cover crimp section 122. Furthermore, the wire connection section 120 is configured having a length continuously and integrally covering from a portion on the front side from a front end Wap1 of the conductor exposed section Wap to a portion on the rear side from a front end Wb1 of the portion to which the cover Wb is attached, in a state of being crimped onto the end portion of the wire W.

Then, as illustrated in FIG. 20, a connection structure of the crimp terminal 110 with respect to the wire W is configured such that the conductor exposed section Wap of the end portion of the wire W is disposed on the wire connection section 120 in a state where a waterproof sheet 130 is disposed in a frame shape on an inner surface of the wire connection section 120. Furthermore, as illustrated in FIG. 21, the pair of left and right caulking pieces 126 and 127 caulk round inwardly. Furthermore, as illustrated in FIG. 22, an opening 128 that is the front end of the wire connection section 120 prevents infiltration of moisture by crushing and closing the front end of the wire connection section 120, and occurrence of galvanic corrosion of the conductor Wa is prevented when the crimp terminal 110 is configured of different kinds of metals.

SUMMARY

However, in the connection structure of the crimp terminal with respect to the wire of the related art described in JP-A-2013-80682, a crushing and closing process of the front end of the wire connection section 120 is necessary after the caulking pieces 126 and 127 caulk round inwardly with respect to the end portion of the wire W. There is a problem that man-hours and processing costs are increased, accordingly. Furthermore, since presence or absence or an assembled state of the waterproof sheet 130 cannot be confirmed from the outside after crimping, there is a problem that determining the guarantee of waterproof performance is difficult.

The present invention is made in view of the situations described above and an object of the invention is to provide a connection structure of a crimp terminal with respect to a wire that can ensure a reliable waterproof performance without applying extra man-hours.

In order to achieve the above object, the connection structure of the crimp terminal with respect to the wire according to the invention has the following (1) to (8) features.

(1) A connection structure of a crimp terminal with respect to a wire including:

the wire that has a conductor and a cover that covers the conductor; and a crimp terminal of which an electrical connection section that is electrically connected to a counterpart terminal is formed in a front portion and a wire connection section that is crimped onto an end portion of the wire is formed in a rear portion, in which the wire connection section has a conductor crimp section that is crimped onto a conductor exposed section in which a conductor is exposed by removing the cover of the end portion of the wire and a cover crimp section that is crimped onto a part of the cover remained in the end portion of the wire, and the conductor crimp section is formed on the front side and the cover crimp section is formed on the rear side, in which the wire connection section of a state being crimped onto the end portion of the wire covers from a portion on a front side from the front end of the conductor exposed section to a portion on a rear side from a front end of a part of the cover, in which the connection structure further includes a waterproof sheet that is disposed in an inner surface of the wire connection section and has an opening section in a position corresponding to the conductor exposed section, in which the waterproof sheet is configured such that a front end of the waterproof sheet is positioned on the front side from the front end of the conductor crimp section, and in which the wire connection section of a state being crimped onto the end portion of the wire is configured such that the conductor crimp section and the conductor exposed section are electrically connected to each other through the opening section formed in the waterproof sheet, and front and rear portions of a connection portion between the conductor crimp section and the conductor exposed section are closed by the waterproof sheet.

(2) The connection structure of a crimp terminal with respect to a wire according to configuration of (1), in which the waterproof sheet is attached to the inner surface of the wire connection section by an adhesive layer provided on a surface of a base sheet.

(3) The connection structure of a crimp terminal with respect to a wire according to the configuration of (1), in which an adhesive layer is provided in a surface with which the wire comes into contact in the waterproof sheet, (4) A connection structure of a crimp terminal with respect to a wire including:

the wire that has a conductor and a cover that covers the conductor; and a crimp terminal of which an electrical connection section that is electrically connected to a counterpart terminal is formed in a front portion and a wire connection section that is crimped onto an end portion of the wire is formed in a rear portion, in which the wire connection section has a conductor crimp section that is crimped onto a conductor exposed section in which a conductor is exposed by removing the cover of the end portion of the wire and a cover crimp section that is crimped onto a part of the cover remained in the end portion of the wire, and the conductor crimp section is formed on the front side and the cover crimp section is formed on the rear side, in which the wire connection section of a state being crimped onto the end portion of the wire covers from a portion on a front side from the front end of the conductor exposed section to a portion on a rear side from a front end of a part of the cover, in which the connection structure further includes a waterproof sheet that is disposed in an inner surface of the wire connection section and has an opening section in a position corresponding to the conductor exposed section, in which the waterproof sheet is configured such that a front end of the waterproof sheet is positioned on the front side from the front end of the conductor exposed section, in which a protruded strip is formed in the conductor crimp section along an inner peripheral surface having a U shape; and in which the wire connection section of a state being crimped onto the end portion of the wire is configured such that the protruded strip is positioned between the front end of the waterproof sheet and the front end of the conductor exposed section, the conductor crimp section and the conductor exposed section are electrically connected to each other through the opening section formed in the waterproof sheet, and front and rear portions of a connection portion between the conductor crimp section and the conductor exposed section are closed by the waterproof sheet.

(5) The connection structure of a crimp terminal with respect to a wire according to the configuration of (4), in which the waterproof sheet is configured such that the front end of the waterproof sheet is positioned on the front side from the front end of the conductor crimp section and the rear end of the waterproof sheet is positioned on the rear side from the rear end of the cover crimp section.

(6) The connection structure of a crimp terminal with respect to a wire according to the configuration of (4), in which the protruded strip is positioned on a rear end side from the front end of the conductor crimp section.

(7) A connection structure of a crimp terminal with respect to a wire including:

the wire that has a conductor and a cover that covers the conductor; and a crimp terminal of which an electrical connection section that is electrically connected to a counterpart terminal is formed in a front portion and a wire connection section that is crimped onto an end portion of the wire is formed in a rear portion, in which the wire connection section has a conductor crimp section that is crimped onto a conductor exposed section in which a conductor is exposed by removing the cover of the end portion of the wire and a cover crimp section that is crimped onto a part of the cover remained in the end portion of the wire, and the conductor crimp section is formed on the front side and the cover crimp section is formed on the rear side, in which the wire connection section of a state being crimped onto the end portion of the wire covers from a portion on a front side from the front end of the conductor exposed section to a portion on a rear side from a front end of a part of the cover, in which the connection structure further includes a waterproof sheet that is disposed in an inner surface of the wire connection section and has an opening section in a position corresponding to the conductor exposed section, in which the waterproof sheet is configured such that a front end of the waterproof sheet is positioned on the front side from the front end of the conductor exposed section, in which a confirmation window is provided in the wire connection section for visibly confirming the waterproof sheet positioned inside thereof from outside of the wire connection section, and in which the wire connection section of a state being crimped onto the end portion of the wire is configured such that the conductor crimp section and the conductor exposed section are electrically connected to each other through the opening section formed in the waterproof sheet, and front and rear portions of a connection portion between the conductor crimp section and the conductor exposed section are closed by the waterproof sheet.

(8) The connection structure of a crimp terminal with respect to a wire according to the configuration of (7), in which the confirmation window is provided in a position corresponding to the rear end of the conductor exposed section in the wire connection section.

According to the connection structure of the crimp terminal with respect to the wire having the configuration (1), it is possible to completely close the portion in which the conductor exposed section of the wire is electrically connected to the conductor crimp section of the terminal through the opening section of the waterproof sheet with the waterproof sheet. Thus, it is possible to ensure a reliable waterproof performance while ensuring an electrical connection performance between the terminal and the wire.

Therefore, even if the crimp terminal is configured of different kinds of metals with respect to the conductor of the wire, the electrolytic solution is not supplied between the different kinds of metals. Thus, it is possible to suppress the galvanic corrosion that may occur in the wire made of, for example, aluminum or an aluminum alloy that is crimped onto the conductor crimp section made of copper or a copper alloy.

Furthermore, it is possible to close the front of the conductor exposed section with the waterproof sheet only by caulking the end portion of the wire with the pair of caulking pieces of the wire connection section round inwardly so as to surround the end portion of the wire. Thus, it is not necessary to add crushing process to close the opening generated on the front of the conductor exposed section in addition to the caulking process. Reduction of man-hours and processing costs is achieved, accordingly. Furthermore, since the waterproof sheet protrudes from the front end and the rear end of the wire connection section in a state after the wire is crimped, it is possible to immediately confirm the presence or absence, abnormality of the assembled state, or the like of the assembly of the waterproof sheet when viewed from the outside. Thus, it is possible to easily determine the guarantee of waterproof performance.

According to the connection structure of the crimp terminal with respect to the wire having the configuration (2), since the waterproof sheet is attached to the inner surface of the wire connection section through the adhesive layer, there is no concern that the waterproof sheet is deviated when crimping, and waterproof reliability is enhanced.

According to the connection structure of the crimp terminal with respect to the wire having the configuration (3), there is no concern that the wire is deviated when crimping and improvement of crimping quality is achieved.

According to the connection structure of the crimp terminal with respect to the wire having the configuration (4), it is possible to completely cover the portion in which the conductor exposed section of the wire is electrically connected to the conductor crimp section of the terminal through the opening section of the waterproof sheet with the waterproof sheet. Thus, it is possible to ensure the waterproof performance while ensuring the electrical connection performance between the terminal and the wire. Specifically, the protruded strip formed in the inner surface of the conductor crimp section prevents the front end of the conductor exposed section from extending forward and protruding from the waterproof sheet by the wire connection section when crimping. Thus, it is possible to reliably close the front of the conductor exposed section by the waterproof sheet and it is possible to ensure a high waterproof performance.

Therefore, even if the crimp terminal is configured of different kinds of metals with respect to the conductor of the wire, the electrolytic solution is not supplied between the different kinds of metals. Thus, the galvanic corrosion is suppressed that may occur in the wire made of, for example, aluminum or an aluminum alloy, that is crimped onto the conductor crimp section made of copper or a copper alloy.

Furthermore, since the protrusion of the conductor exposed section to the front side is not present by the existence of the protruded strip, it is possible to close the front of the conductor exposed section with the waterproof sheet only by caulking the end portion of the wire round inwardly with the pair of caulking pieces of the wire connection section so as to surround the end portion of the wire. Thus, it is not necessary to add the crushing process to close the opening generated in the front of the conductor exposed section, in addition to the caulking process as the related art. The reduction of man-hours and processing costs is achieved, accordingly.

Furthermore, even if a height of the caulking is high in a tolerance range due to manufacturing variations of the conductor crimp section, since the protruded strip reliably bites the waterproof sheet, it is possible to reliably hold the waterproof sheet that may move forward when crimping.

According to the connection structure of the crimp terminal with respect to the wire having the configuration (5), the waterproof sheet protrudes from the front end and the rear end of the wire connection section in a state after the wire is crimped. Thus, it is possible to immediately confirm the presence or absence, the abnormality of the assembled state, or the like of the assembly of the waterproof sheet when viewed from the outside. Thus, it is possible to easily determine the guarantee of waterproof performance.

According to the connection structure of the crimp terminal with respect to the wire having the configuration (6), the front end side of the conductor crimp section on the front end side from the position in which the protruded strip is formed is an enlarged diameter section and it is possible to prevent the waterproof sheet that is extruded by the protruded strip when crimping from widening to the front by the wire connection section. That is, if the height of the caulking is low in the tolerance range by manufacturing variations of the conductor crimp section, the waterproof sheet extruded to the front by the protruded strip is widened to the front and seal performance of the front of the conductor exposed section could be reduced. However, according to the configuration, the enlarged diameter section of the front end side of the conductor crimp section can suppress the waterproof sheet from widening to the front.

Therefore, since it is possible to cope with manufacturing variations when crimping by the existence of the enlarged diameter section that is configured on the front end side from the protruded strip of conductor crimp section, it is possible to safely ensure a high waterproof performance by the waterproof sheet.

According to the connection structure of the crimp terminal with respect to the wire having the configuration (7), it is possible to completely close the front and rear of the portion in which the conductor exposed section of the wire is electrically connected to the conductor crimp section through the opening section of the waterproof sheet by the waterproof sheet. Thus, it is possible to ensure the reliable waterproof performance while ensuring the electrical connection performance between the terminal and the wire. Furthermore, since the front of the conductor exposed section can be closed with the waterproof sheet only by caulking round inwardly the end portion of the wire with the pair of caulking pieces of the wire connection section so as to surround the end portion of the wire, there is no need to add the crushing process to close the opening generated in the front of the conductor exposed section after the caulking process. Accordingly, the reduction of man-hours and processing costs is achieved. Furthermore, since the waterproof sheet provided in the inside thereof can be visibly confirmed from the confirmation window formed in the wire connection section, in a state after the wire connection section is crimped onto the wire, it is possible to immediately confirm the presence or absence, abnormality of the assembled state, or the like of the assembly of the waterproof sheet when viewed from the outside and it is possible to easily determine the guarantee of waterproof performance.

According to the connection structure of the crimp terminal with respect to the wire having the configuration (8), since the confirmation window of the waterproof sheet is provided in the position corresponding to the rear end of the conductor exposed section, there is no concern that the crimping of the conductor exposed section is affected by the formation of the confirmation window.

According to the connection structure of the crimp terminal with respect to the wire of the invention, it is possible to ensure the reliable waterproof performance while ensuring the electrical connection performance between the terminal and the wire. Furthermore, it is not necessary to add the crushing process to close the opening generated in the front of the conductor exposed section after the caulking process and the reduction of man-hours and processing costs is achieved, accordingly. Furthermore, it is possible to easily determine the guarantee of waterproof performance.

The invention is described briefly in the above. Furthermore, details of the invention will be further clarified by reading through aspects (hereinafter, referred to as "embodiments") for carrying out the invention described below with reference to the accompanying drawings.

BRIEF DESCRIPTION OF THE DRAWINGS

FIGS. 7A to 7C are cross-sectional view describing a structure of the waterproof sheet illustrated in FIG. 6, in which FIG. 7A is a schematic cross-sectional view of the waterproof sheet, FIG. 7B is an enlarged cross-sectional view of a portion of FIG. 7A, and FIG. 7C is an enlarged cross-sectional view illustrating a state where a peeling sheet on a lower side in FIG. 7B is peeled.

DETAILED DESCRIPTION OF EMBODIMENTS

Hereinafter, an embodiment of the invention will be described with reference to drawings.

First Embodiment

Figure 1:
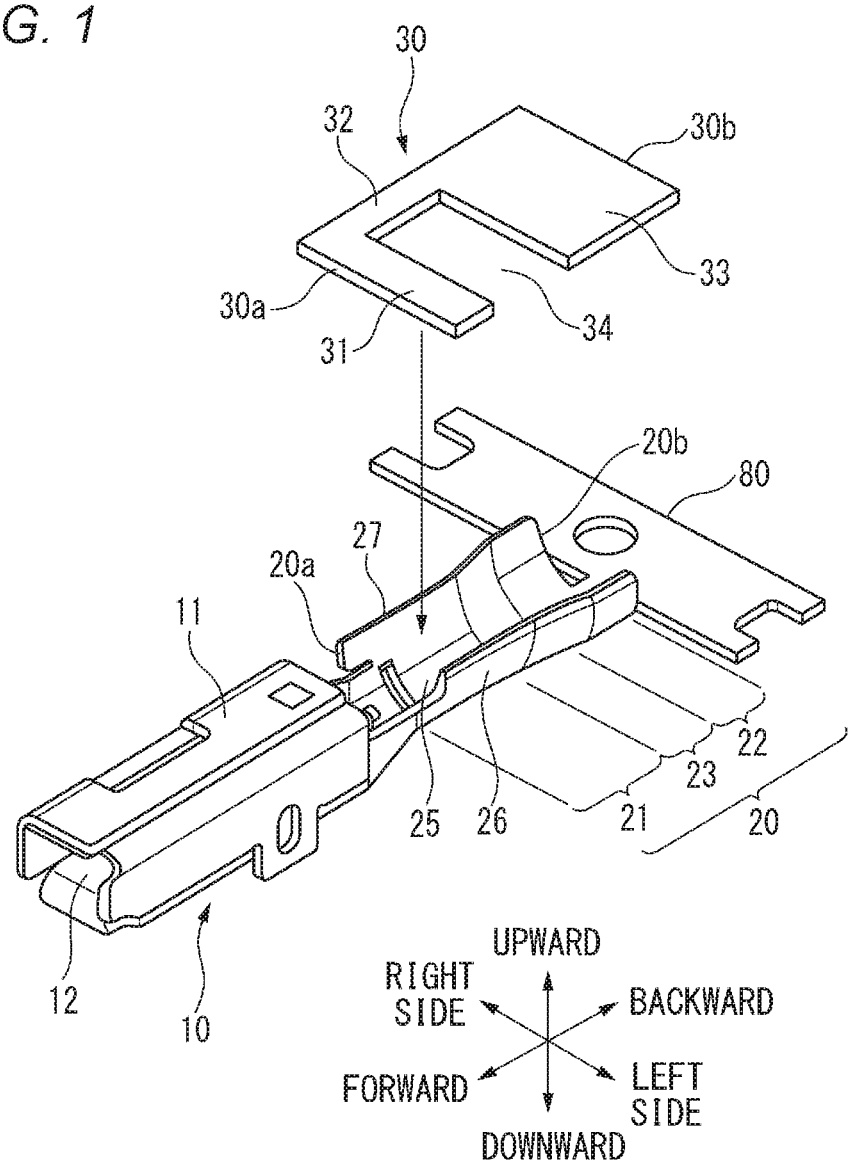
FIG. 1 is an explanatory view describing a connection structure of a crimp terminal with respect to a wire of a first embodiment of the invention and a perspective view illustrating an aspect in which a waterproof sheet is disposed in a wire connection section of the crimp terminal.
Figure 2:
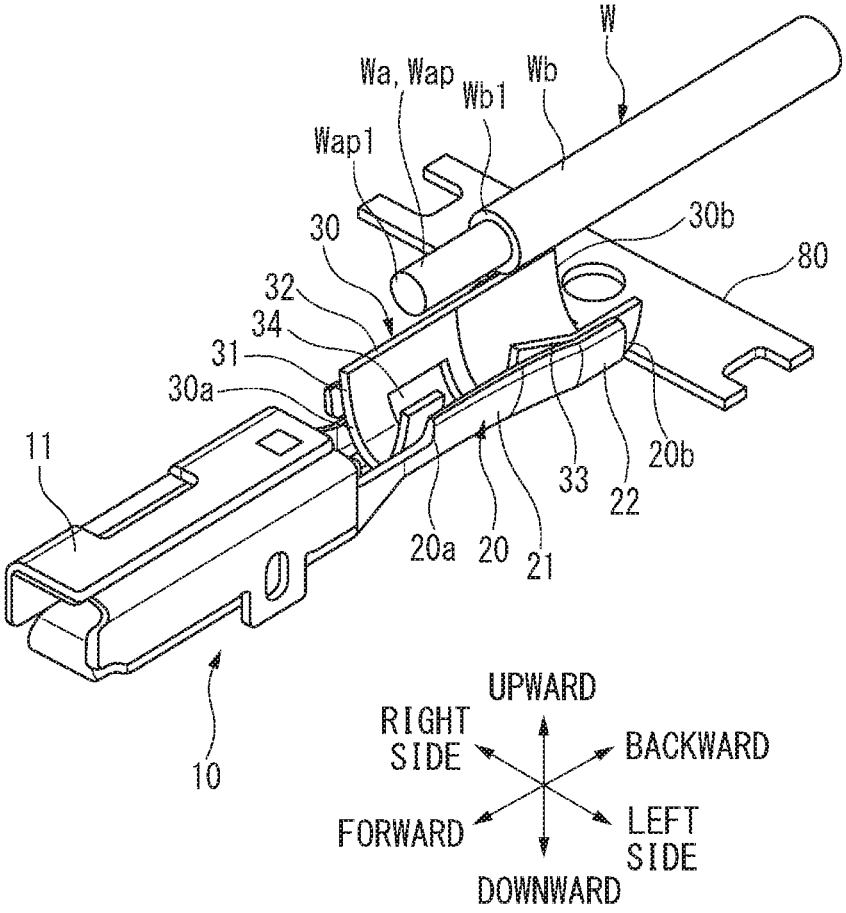
FIG. 2 is an explanatory view describing the connection structure of the crimp terminal with respect to the wire of the first embodiment of the invention and a perspective view illustrating an aspect in which an end portion of the wire is disposed in the wire connection section of the crimp terminal from above the waterproof sheet as the next process of FIG. 1.
Figure 3:
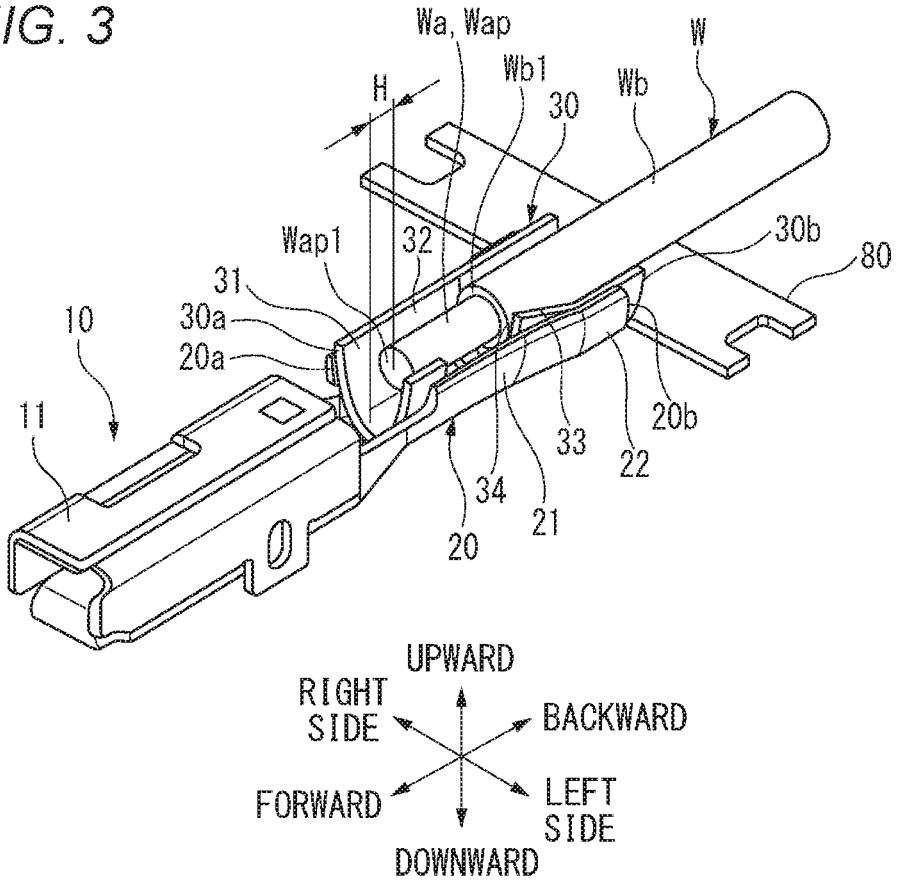
FIG. 3 is an explanatory view describing the connection structure of the crimp terminal with respect to the wire of the first embodiment of the invention and a perspective view illustrating a position where a conductor exposed section is disposed when disposing the end portion of the wire is in the wire connection section of the crimp terminal from above the waterproof sheet.
Figure 4:
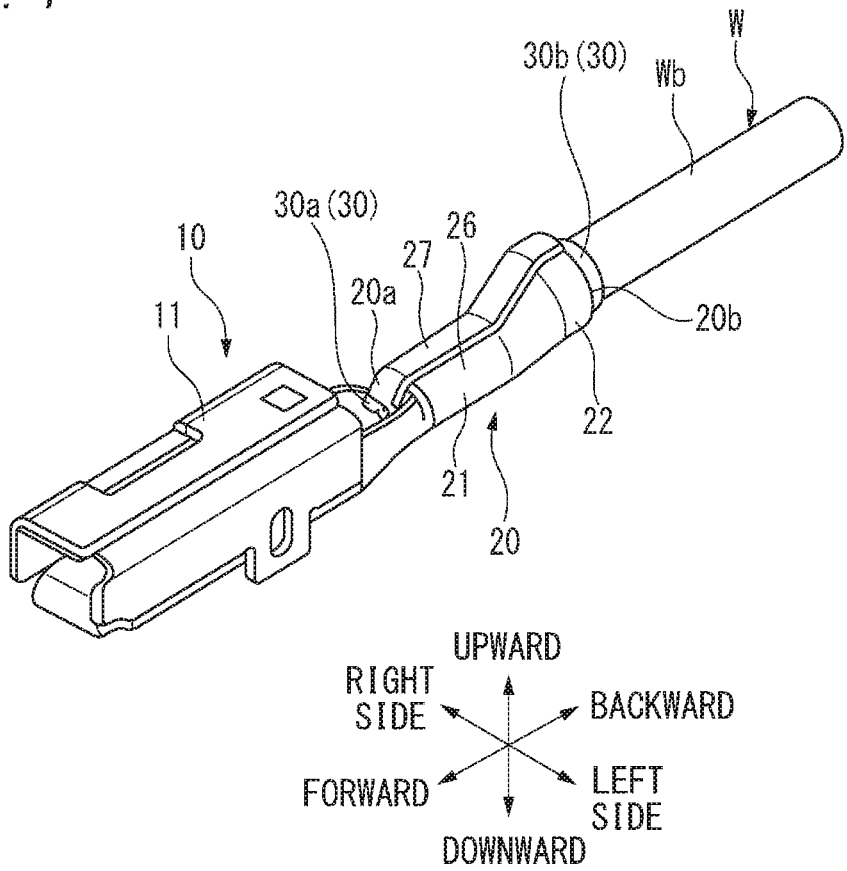
FIG. 4 is an external perspective view of the connection structure of the crimp terminal with respect to the wire of the first embodiment of the invention.

FIG. 1 is an explanatory view describing a connection structure of a crimp terminal with respect to a wire of a first embodiment of the invention and a perspective view illustrating an aspect in which a waterproof sheet is disposed in a wire connection section of the crimp terminal. FIG. 2 is an explanatory view describing the connection structure of the crimp terminal with respect to the wire of the first embodiment of the invention and a perspective view illustrating an aspect in which an end portion of the wire is disposed in the wire connection section of the crimp terminal from above the waterproof sheet as the next process of FIG. 1. FIG. 3 is an explanatory view describing the connection structure of the crimp terminal with respect to the wire of the first embodiment of the invention and a perspective view illustrating a position where a conductor exposed section is disposed when disposing the end portion of the wire is in the wire connection section of the crimp terminal from above the waterproof sheet. FIG. 4 is an external perspective view of the connection structure of the crimp terminal with respect to the wire of the first embodiment of the invention.

For directions in the drawings, a direction toward a counterpart terminal that is one side of the terminal in a longitudinal direction (consistent with a longitudinal direction of the wire) is referred to as forward, the opposite direction thereto is referred to as backward, a side on which the wire is mounted on the crimp terminal is referred to as upward, the opposite direction thereto is referred to as downward, one side and the other side of the terminal forward in a width direction are referred to as a left side and a right side, respectively.

As illustrated in FIGS. 1 and 2, a crimp terminal 10 of a first embodiment in which a conductor Wa is used as a connection structure with respect to a wire W configured of aluminum or an aluminum alloy is formed by pressing (punching) a metal plate made of, for example, copper or a copper alloy. The crimp terminal 10 is a female terminal having a box section (electrical connection section) 11 in a front portion for electrically connecting to a counterpart male terminal. The box section 11 includes a spring piece 12 clamping the counterpart male terminal inside thereof. The crimp terminal 10 has a wire connection section 20 crimping an end portion of the wire in a rear portion of the box section 11. The crimp terminal 10 is press-molded in a state of continuous in a chain shape in a carrier 80.

The wire connection section 20 has a conductor crimp section 21 in a position of the front side, which is crimped onto a conductor exposed section Wap in which the conductor Wa is exposed by removing a cover Wb of the end portion of the wire W. The wire connection section 20 has a cover crimp section 22 in a position of a rear side thereof, which is crimped onto a portion to which the cover Wb remained in the end portion of the wire W is attached through a joint section 23. The joint section 23 connects the conductor crimp section 21 and the cover crimp section 22 so that an upper end of the conductor crimp section 21 on the rear side is continuous to an upper end of the cover crimp section 22 on the front side. The conductor crimp section 21 and the cover crimp section 22 are respectively formed in sizes corresponding to a diameter of the conductor exposed section Wap or a diameter of the portion to which the cover Wb is attached.

The conductor crimp section 21 and the cover crimp section 22 have a common bottom plate section 25 and a pair of left and right common caulking pieces 26 and 27. The caulking pieces 26 and 27 are erected upwardly from left and right side edges of the common bottom plate section 25, and caulk the conductor exposed section Wap and the portion to which the cover Wb is attached by being bent inwardly so as to surround the conductor exposed section Wap and the portion to which the cover Wb is attached of the wire W in a state where the conductor exposed section Wap and the portion to which the cover Wb is attached come into pressed contact with an upper surface of the bottom plate section 25. The conductor crimp section 21, the cover crimp section 22, and the joint section 23 are formed having a cross section of a U shape that is continuous from a front end of the conductor crimp section 21 to a rear end of the cover crimp section 22. Furthermore, the wire connection section 20 is configured having a length continuously and integrally covering from a portion on the front side from a front end Wap1 of the conductor exposed section Wap to a portion on the rear side from a front end Wb1 of the portion to which the cover Wb is attached, in a state of being crimped onto the end portion of the wire W.

Then, the connection structure of the crimp terminal 10 with respect to the wire W is realized by the following sequence.

First, as illustrated in FIGS. 1 and 2, a waterproof sheet 30 having an opening section 34 in a position corresponding to the conductor exposed section Wap is disposed in an inner surface of the wire connection section 20 of the crimp terminal 10 that is formed having the cross section of a U shape.

That is, as illustrated in FIG. 1 the waterproof sheet 30 is formed in a U shape or a rectangular shape (not illustrated) depending on a position of the opening section 34. The waterproof sheet 30 has a front sheet section 31 that is extended in a width direction of the wire connection section 20 in a position of the front side from the opening section 34 and has a rear sheet section 33 that is extended in the width direction of the wire connection section 20 in a position of the rear side from the opening section 34. Furthermore, the waterproof sheet 30 has a side sheet section 32 joining the front sheet section 31 and the rear sheet section 33 in a position of a side of the opening section 34.

Furthermore, the waterproof sheet 30 is formed having a length such that a front end 30*a* and a rear end 30*b* of the waterproof sheet 30 protrude from a front end 20*a* and a rear end 20*b* of the wire connection section 20 to the outside, when the wire connection section 20 is crimped onto the end portion of the wire W. Specifically, the waterproof sheet 30 is formed having a length such that the front end 30*a* of the front sheet section 31 is positioned on the front side from the front end 20*a* of the conductor crimp section 21 and the rear end 30*b* of the rear sheet section 33 is positioned on the rear side from the rear end 20*b* of the cover crimp section 22.

Similar to a waterproof sheet 40 (see FIGS. 7A to 7C) according to a third embodiment described below, the waterproof sheet 30 according to the first embodiment is a both-surface adhesive sheet in which adhesive layers are provided on both surfaces of a base sheet. Then, a peeling sheet is provided on each adhesive layer of the waterproof sheet 30 through a peeling layer before using.

Thus, the waterproof sheet 30 is attached to the inner surface of the wire connection section 20 by the adhesive layer that is exposed by peeling the peeling sheet in one surface of the waterproof sheet 30.

After the waterproof sheet 30 is disposed in the inner surface of the wire connection section 20, the adhesive layer is exposed by peeling the peeling sheet in the other surface of the waterproof sheet 30 and then the end portion of the wire W that is peeled (a predetermined length of the cover Wb is peeled) is disposed on the upper surface of the bottom plate section 25 of the wire connection section 20. At this time, as illustrated in FIG. 3, the end portion of the wire W is disposed on the upper surface of the bottom plate section 25 of the wire connection section 20 such that the front end Wap1 of the conductor exposed section Wap is positioned on the rear side from the front end 30*a* of the waterproof sheet 30 by a dimension H and the front end Wb1 of the portion to which the cover is attached is positioned on the front side from the rear end 30*b* of the waterproof sheet 30 and on the front side from the rear end 20*b* of the wire connection section 20.

Then, in this state, as illustrated in FIG. 4, the wire connection section 20 is crimped onto the end portion of the wire W. That is, the left and right caulking pieces 26 and 27 are caulked by inwardly bending sequentially and the other caulking pieces 27 is overlapped on an end portion of one caulking piece 26 so as to surround the end portion of the wire W.

By carrying out caulking as such, the conductor crimp section 21 of the crimp terminal 10 and the conductor exposed section Wap of the wire W are electrically connected to each other through the opening section 34 formed in the waterproof sheet 30, and the front and rear of the connection portion between the conductor crimp section 21 and the conductor exposed section Wap are closed by the waterproof sheet 30. Furthermore, in this state, the front end 30*a* and the rear end 30*b* of the waterproof sheet 30 are protruded from the front end 20*a* and the rear end 20*b* of the wire connection section 20 to the outside, and the connection structure of the first embodiment of the invention is completed.

As described above, according to the connection structure of the crimp terminal 10 with respect to the wire W of the first embodiment of the invention, the front and rear of the portion in which the conductor exposed section Wap of the wire W is electrically connected to the conductor crimp section 21 of the crimp terminal 10 through the opening section 34 of the waterproof sheet 30 can be completely closed. Thus, it is possible to ensure a reliable waterproof performance while ensuring the electrical connection performance between the crimp terminal 10 and the wire W.

Therefore, even if the crimp terminal 10 is configured of different kinds of metals with respect to the conductor Wa of the wire W, electrolytic solution is not supplied between the different kinds of metals. Thus, galvanic corrosion is suppressed that may occur in the conductor Wa made of aluminum or an aluminum alloy that is crimped onto the conductor crimp section 21 made of copper or a copper alloy.

The front side of the conductor exposed section Wap can be closed by the front end side of the waterproof sheet 30 that is crimped round simultaneously only by caulking the pair of left and right common caulking pieces 26 and 27 of the wire connection section 20 round inwardly so as to surround the end portion of the wire W. Therefore, it is not necessary to add a crushing process to close the opening formed in the front of the conductor exposed section Wap in addition to the caulking process. Thus, reduction of man-hours and processing costs are achieved, accordingly.

Furthermore, in a state after the wire W is crimped, since the front end 30*a* and the rear end 30*b* of the waterproof sheet 30 protrude from the front end 20*a* and the rear end 20*b* of the wire connection section 20, it is possible to immediately confirm the presence or absence, abnormality of the assembled state, or the like of the assembly of the waterproof sheet 30 when viewed from the outside. Thus, it is possible to easily determine the guarantee of waterproof performance.

Furthermore, since the waterproof sheet 30 is attached to the inner surface of the wire connection section 20 by the adhesive layer, there is no concern that the waterproof sheet 30 is deviated when crimping and it is possible to increase waterproof reliability.

Furthermore, since the adhesive layer is also provided in a surface of the waterproof sheet 30 coming into contact with the wire W, there is no concern that the wire W is deviated and the improvement of crimping quality can be achieved.

More specifically, the following advantages are achieved by providing the adhesive layer in the one surface of the waterproof sheet 30 and attaching one surface of the waterproof sheet 30 to the inner surface of the wire connection section 20 and providing the adhesive layer also in the other surface of the waterproof sheet 30, and adhering the other surface thereof to the cover Wb of the wire W.

In a situation before the crimp terminal 10 is crimped onto the end portion of the wire W, the waterproof sheet 30 disposed with respect to the wire connection section 20 is difficult to move by the adhesive of one surface of the waterproof sheet 30 and the wire W disposed with respect to the waterproof sheet 30 is difficult to move by the adhesive layer of the other surface of the waterproof sheet 30. As described above, arrangement positions of the wire connection section 20, the waterproof sheet 30, and the wire W are stably fixed and thus it is possible to prevent connection failure due to the position deviations of the members when crimping.

Furthermore, the wire W extends in the longitudinal direction and then a cross section of the wire W may become thin in a high temperature environment. If the adhesive layer is not provided in the waterproof sheet, the cross section of the wire is thin and thereby there is a concern that a gap is formed between the waterproof sheet and the cover. However, if the adhesive layers are provided in both surfaces of the waterproof sheet 30, the waterproof sheet 30 is deformed following the deformation of the wire W, even if the wire W is thin in the end portion of the wire W onto which the crimp terminal 10 is crimped. Thus, it is possible to prevent the gap from forming between the wire connection section 20 and the waterproof sheet 30, and between the waterproof sheet 30 and the cover Wb. Thus, infiltration of water into the crimp terminal 10 through between the wire connection section 20 and the waterproof sheet 30, and between the waterproof sheet 30 and the cover Wb is prevented so that the improvement of the waterproof performance is achieved.

Furthermore, in the crimp terminal 10, the caulking pieces 26 and 27 of the caulked wire connection section 20 may be opened slightly in a direction in which a holding force of the caulking pieces 26 and 27 is weakened with lapse of time. If the adhesive layer is not provided in the waterproof sheet, there is a concern that the gap is formed between the wire connection section and the waterproof sheet by opening of the caulking pieces. However, if the adhesive layers are provided in both surfaces of the waterproof sheet 30, the waterproof sheet 30 bonded to the cover Wb gives stress to the caulking pieces 26 and 27, which resists the deformation of the caulking pieces 26 and 27, even if the caulking pieces 26 and 27 of the caulked wire connection section 20 are opened. Thus, it is possible to prevent the gap from occurring between the wire connection section 20 and the waterproof sheet 30, and between the waterproof sheet 30 and the cover Wb. Thus, infiltration of water into the crimp terminal 10 through between the wire connection section 20 and the waterproof sheet 30, and between the waterproof sheet 30 and the cover Wb is prevented so that the improvement of the waterproof performance is achieved.

Moreover, the invention is not limited to the configuration in which the adhesive layers are provided in the both surfaces of the waterproof sheet 30. The adhesive layer may be provided in one surface or the other surface of the waterproof sheet 30 described above. Even if the adhesive layer is provided in any one of the surfaces of the waterproof sheet 30, advantages such as prevention of the connection failure when crimping and the improvement of the waterproof performance are achieved. Furthermore, the configuration is not limited to the adhesive sheet such as the waterproof sheet 30 described above in which the adhesive layer is provided in the base sheet. A waterproof sheet in which adhesive is applied to one surface of a butyl sheet or a base material sheet may be attached to the inner surface of the wire connection section 20.

The invention is not limited to the embodiment described above and can be appropriately modified and improved. In addition, in the embodiment described above, the material, the shape, the dimension, the number, the arrangement position, and the like of each configuration element are arbitrary and are not limited as long as it can achieve the invention.

Second Embodiment

Figure 5:
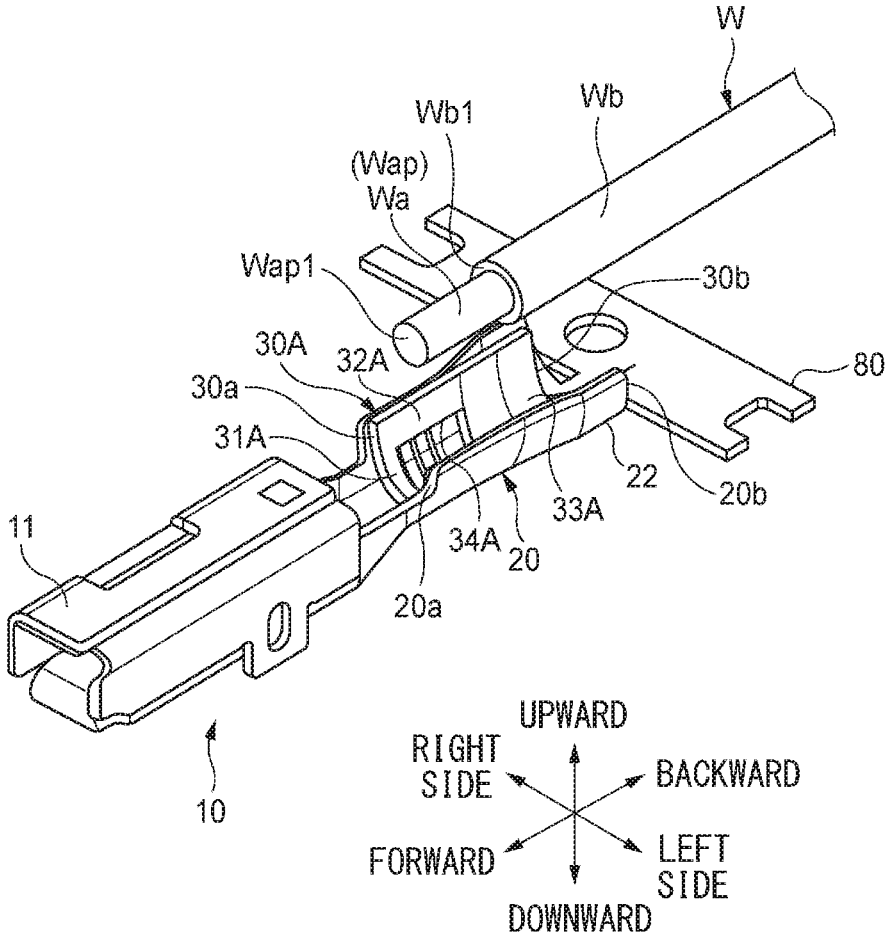
FIG. 5 is an explanatory view describing a connection structure of a crimp terminal with respect to a wire of a second embodiment of the invention and a perspective view illustrating an aspect in which an end portion of the wire is disposed in a wire connection section of the crimp terminal from above a waterproof sheet.

Now, referring to the drawings, a second embodiment will be described below. FIG. 5 is an explanatory view describing a connection structure of a crimp terminal with respect to a wire of a second embodiment of the invention and is a perspective view illustrating an aspect in which an end portion of the wire is disposed in a wire connection section of the crimp terminal from above a waterproof sheet.

In the connection structure of a crimp terminal 10A with respect to a wire W of the second embodiment, since a waterproof sheet 30A is used instead of the waterproof sheet 30 according to the first embodiment described above, the same symbols are given to the other configuration members, and detailed description thereof will be omitted.

The waterproof sheet 30A according to the second embodiment is formed in a U shape similar to the waterproof sheet 30 according to the first embodiment.

The waterproof sheet 30A has a front sheet section 31A that is extended in a width direction of the wire connection section 20 in a position of the front side from the opening section 34 and has a rear sheet section 33A that is extended in the width direction of the wire connection section 20 in a position of the rear side from the opening section 34. Furthermore, the waterproof sheet 30A has a side sheet section 32A joining the front sheet section 31A and the rear sheet section 33A in a position of a side of the opening section 34. The waterproof sheet 30A is formed having a length (a length in an axial direction of the terminal) that is shorter than that of the waterproof sheet 30 according to the first embodiment.

That is, as illustrated in FIG. 5, the waterproof sheet 30A according to the second embodiment is formed having the length such that a front end 30*a* and a rear end 30*b* of the waterproof sheet 30A do not protrude from a front end 20*a* and a rear end 20*b* of the wire connection section 20 to the outside, when the wire connection section 20 is disposed in the inner surface of the wire connection section 20. Specifically, as illustrated in FIG. 5, the waterproof sheet 30A is formed having a length such that the front end 30*a* of the front sheet section 31A is positioned on the rear side from the front end 20*a* of the conductor crimp section 21 and the rear end 30*b* of the rear sheet section 33A is positioned on the front side from the rear end 20*b* of the cover crimp section 22, when the wire connection section 20 is disposed in the inner surface of the wire connection section 20.

Similar to a waterproof sheet 40 (see FIGS. 7A to 7C) according to a third embodiment described below, the waterproof sheet 30A according to the second embodiment is a both-surface adhesive sheet in which adhesive layers are provided on both surfaces of a base sheet. Then, a peeling sheet is provided in each adhesive layer of the waterproof sheet 30A before using through a peeling layer.

Thus, the waterproof sheet 30A is attached to the inner surface of the wire connection section 20 by the adhesive layer that is exposed by peeling the peeling sheet in one surface of the waterproof sheet 30A.

After the waterproof sheet 30A is disposed in the inner surface of the wire connection section 20, the adhesive layer is exposed by peeling the peeling sheet in the other surface of the waterproof sheet 30A and then the end portion of the wire W that is peeled is disposed on the upper surface of the bottom plate section 25 of the wire connection section 20.

Thus, in this state, the wire connection section 20 is crimped onto the end portion of the wire W. That is, the left and right caulking pieces 26 and 27 are caulked round inwardly in order so as to surround the end portion of the wire W by a crimping device (not illustrated) and an end portion of the other caulking piece 27 is overlapped on an end portion of one caulking piece 26.

By carrying out caulking as such, the conductor crimp section 21 of the crimp terminal 10A and the conductor exposed section Wap of the wire W are electrically connected to each other through the opening section 34 formed in the waterproof sheet 30A, and the front and rear of the connection portion between the conductor crimp section 21 and the conductor exposed section Wap are closed by the waterproof sheet 30A. Furthermore, in this state, the front end 30*a* and the rear end 30*b* of the waterproof sheet 30A are protruded from the front end 20*a* and the rear end 20*b* of the wire connection section 20 to the outside, and the connection structure of the second embodiment of the invention is completed.

Furthermore, the waterproof sheet 30A according to the second embodiment is formed having the length such that the front end 30*a* and the rear end 30*b* of the waterproof sheet 30A do not protrude from the front end 20*a* and the rear end 20*b* of the wire connection section 20 to the outside, when the waterproof sheet 30A is disposed in the inner surface of the wire connection section 20. Then, a state after the caulking pieces 26 and 27 of the wire connection section 20 are caulked round inwardly in order so as to surround the end portion of the wire W by an anvil and a crimper of the crimping device, similar to the waterproof sheet 30 according to the first embodiment described above, the front end 30*a* and the rear end 30*b* of the waterproof sheet 30A protrude from the front end 20*a* and the rear end 20*b* of the wire connection section 20 to the outside. It is possible to close the front of the conductor exposed section Wap by the front end portion of the waterproof sheet 30A that is rounded and compressed.

Therefore, in a state after crimped onto the wire W, if the front end 30*a* and the rear end 30*b* of the waterproof sheet 30A can protrude from the front end 20*a* and the rear end 20*b* of the wire connection section 20, in a state of being disposed in the inner surface of the wire connection section 20, the waterproof sheet 30A can be sized such that the front end 30*a* and the rear end 30*b* of the waterproof sheet 30A do not protrude from the front end 20*a* and the rear end 20*b* of the wire connection section 20, and the waterproof sheet 30A can be made smaller than the waterproof sheet 30. As a result, it is possible to improve a yield when forming the waterproof sheet 30A.

Third Embodiment

Figure 6:
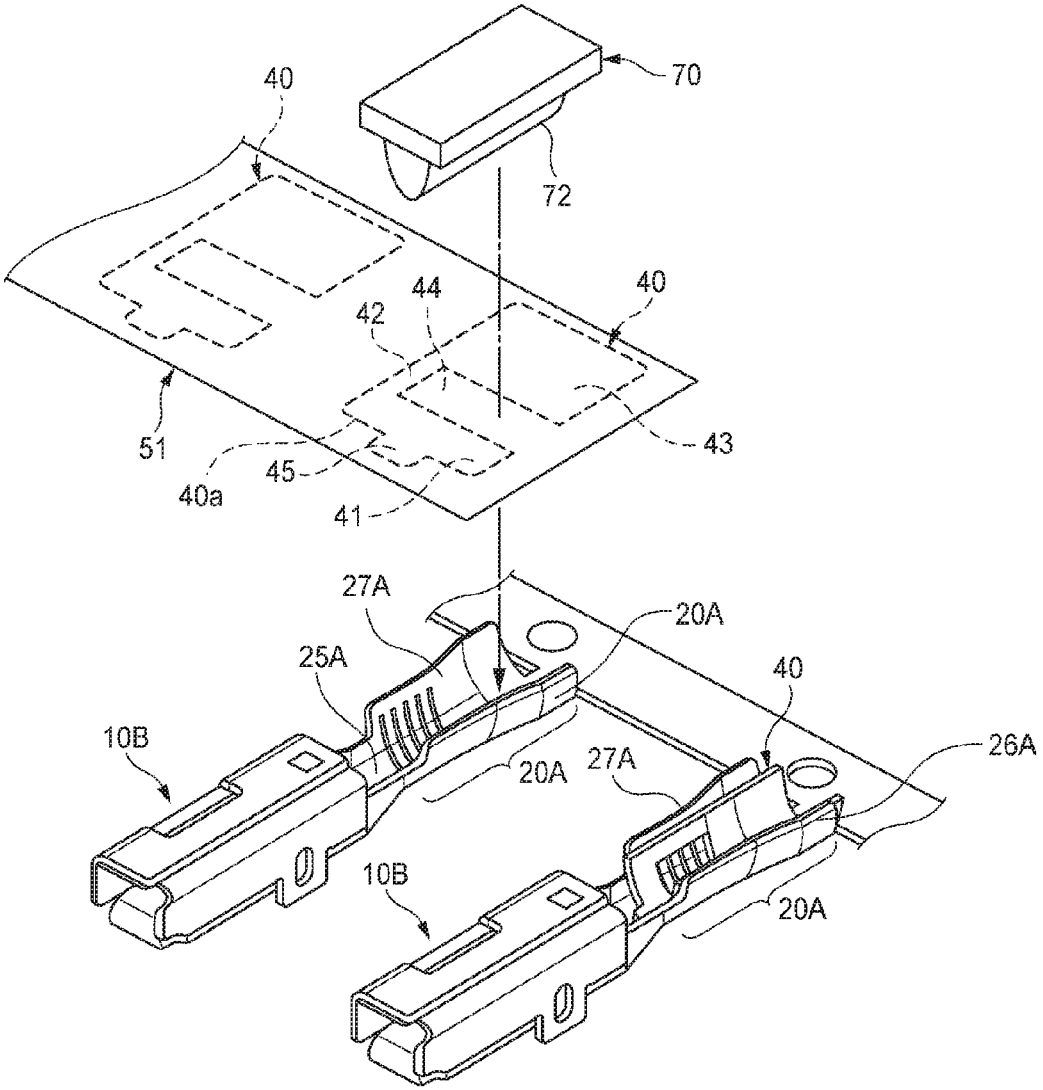
FIG. 6 is an explanatory view describing a connection structure of a crimp terminal with respect to a wire of a third embodiment of the invention and a perspective view illustrating an aspect in which a waterproof sheet is disposed in a wire connection section of the crimp terminal.
Figure 7A:
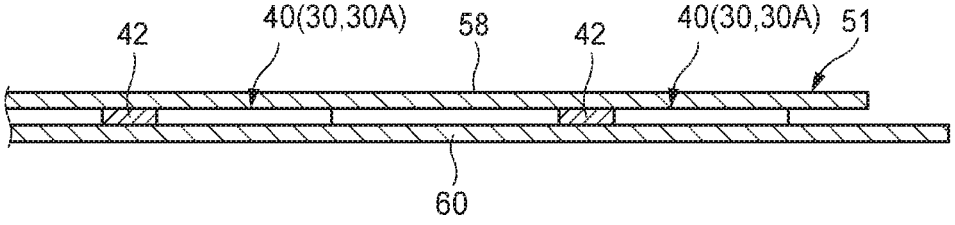
Figure 7B:
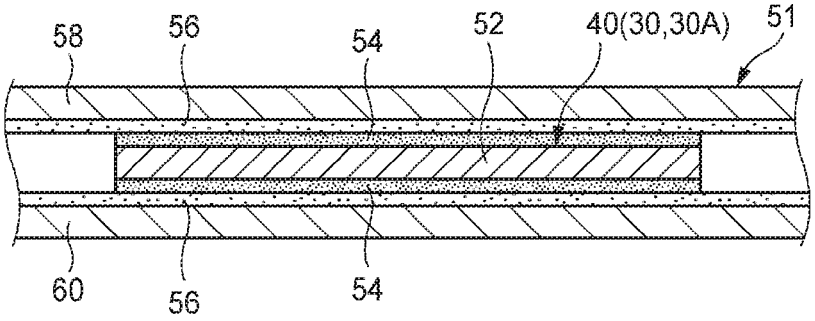
Figure 7C:
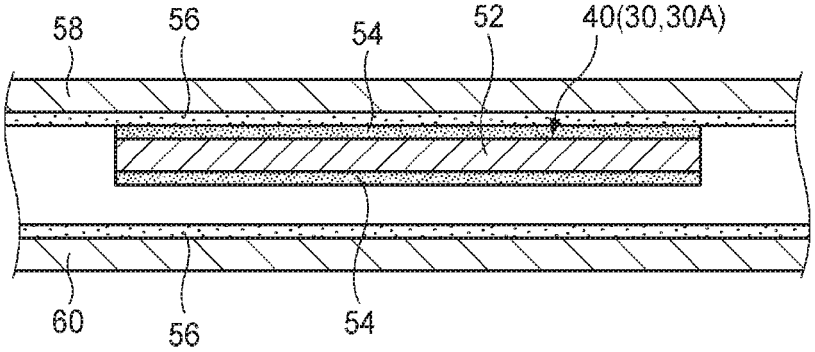
Figure 8:
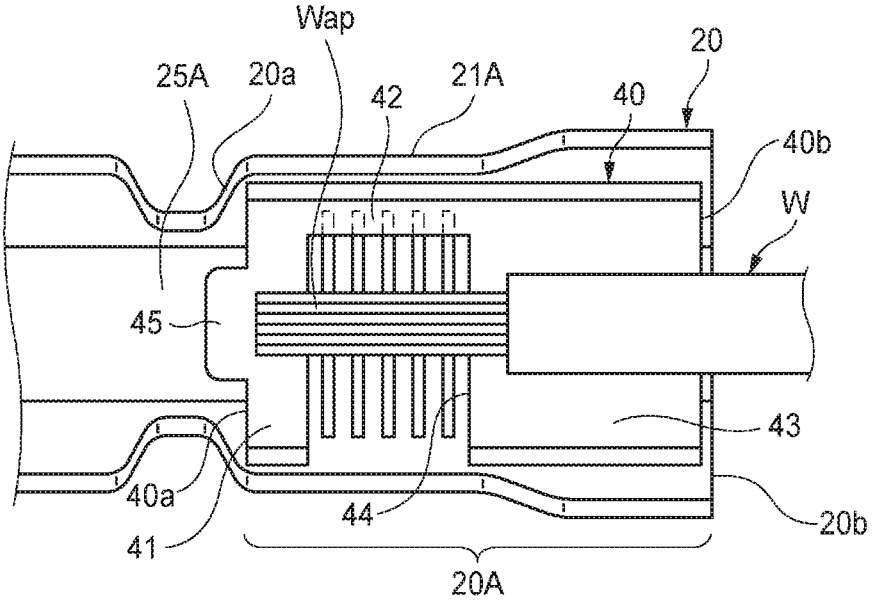
FIG. 8 is an explanatory view describing the connection structure of the crimp terminal with respect to the wire of the third embodiment of the invention and a plan view illustrating an aspect in which an end portion of the wire is disposed in the wire connection section of the crimp terminal from above the waterproof sheet.

FIG. 6 is an explanatory view describing a connection structure of a crimp terminal with respect to a wire of a third embodiment of the invention and a perspective view illustrating an aspect in which a waterproof sheet is disposed in a wire connection section of the crimp terminal. FIGS. 7A to 7C are cross-sectional view describing a structure of the waterproof sheet illustrated in FIG. 6, in which FIG. 7A is a schematic cross-sectional view of the waterproof sheet. FIG. 7B is an enlarged cross-sectional view of a portion of FIG. 7A, and FIG. 7C is an enlarged cross-sectional view illustrating a state where a peeling sheet on a lower side in FIG. 7B is peeled. FIG. 8 is an explanatory view describing the connection structure of the crimp terminal with respect to the wire of the third embodiment of the invention and a plan view illustrating an aspect in which an end portion of the wire is disposed in the wire connection section of the crimp terminal from above the waterproof sheet.

In the connection structure of a crimp terminal 10B with respect to a wire W of the third embodiment, since a waterproof sheet 40 is used instead of the waterproof sheet 30A according to the second embodiment described above, the same symbols are given to the other configuration members, and detailed description thereof will be omitted.

The waterproof sheet 40 according to the third embodiment is formed in a U shape similar to the waterproof sheet 30A according to the second embodiment.

The waterproof sheet 40 has a front sheet section 41 that is extended in a width direction of a wire connection section 20A in a position of the front side from the opening section 44 and has a rear sheet section 43 that is extended in the width direction of the wire connection section 20A in a position of the rear side from the opening section 44. Furthermore, the waterproof sheet 40 has a side sheet section 42 joining the front sheet section 41 and the rear sheet section 43 in a position of a side of the opening section 44. A substantially rectangular swelling section 45 is formed protruding in a front end 40*a* of the waterproof sheet 40.

That is, the waterproof sheet 40 according to the third embodiment is formed such that the swelling section 45 of the front sheet section 41 is protruded on a bottom plate section 25A in the front from the wire connection section 20A, when being disposed in the inner surface of the wire connection section 20A. Specifically, as illustrated in FIG. 8, the waterproof sheet 40 is formed such that the swelling section 45 formed by protruding in the front end 40*a* partially expands a width (a width of the terminal in the longitudinal direction) of the front sheet section 41 when being disposed in the inner surface of the wire connection section 20A.

As illustrated in FIGS. 7A and 7B, the waterproof sheet 40 according to the third embodiment is a both-surface adhesive sheet 51 in which adhesive layers 54 are provided on both surfaces of a base sheet 52. Then, peeling sheets 58 and 60 are provided in each adhesive layer 54 of the waterproof sheet 40 before using through a peeling layer 56.

Thus, as illustrated in FIG. 7C, the waterproof sheet 40 is attached to the inner surface of the wire connection section 20 by the adhesive layer 54 that is exposed by peeling a peeling sheet 60 in one surface of the waterproof sheet 40. As illustrated in FIG. 6, in the both-surface adhesive sheet 51 of the embodiment, a plurality of waterproof sheets 40 are disposed between the long peeling sheets 58 and 60, and it is possible to continuously attach the waterproof sheets 40 to the inner surface of the wire connection section 20A of each crimp terminal 10B.

After the waterproof sheet 40 is disposed in the inner surface of the wire connection section 20A, the waterproof sheet 40 is pressed by a pressing section 72 of a suppression jig 70 from above, and the adhesive layer 54 is bonded in the inner surface of the wire connection section 20A while being familiar with the inner surface thereof. Thereafter, the peeling sheet 58 is peeled in the other surface of the waterproof sheet 40 and the adhesive layer 54 is exposed, and then the end portion of the wire W that is peeled is disposed on the upper surface of the bottom plate section 25A of the wire connection section 20A.

Thus, in this state, the wire connection section 20A is crimped onto the end portion of the wire W. That is, left and right caulking pieces 26A and 27A are caulked round inwardly in order so as to surround the end portion of the wire W by a crimping device (not illustrated) and an end portion of the other caulking piece 27A is overlapped on an end portion of one caulking piece 26A.

By carrying out caulking as such, a conductor crimp section 21A of the crimp terminal 10B and the conductor exposed section Wap of the wire W are electrically connected to each other through the opening section 44 formed in the waterproof sheet 40, and the front and rear of the connection portion between the conductor crimp section 21A and the conductor exposed section Wap are closed by the waterproof sheet 40. Furthermore, in this state, the front end 40*a* and the rear end 40*b* of the waterproof sheet 40 are protruded from the front end 20*a* and the rear end 20*b* of the wire connection section 20A to the outside, and the connection structure of the third embodiment of the invention is completed.

In the waterproof sheet 40 according to the third embodiment, the swelling section 45 is extruded and provided in the front end 40*a* of the waterproof sheet 40 without interfering with the crimper of the crimping device when crimping. Therefore, it is possible to increase an adhesive area (specifically, an adhesive area of the front sheet section 41) of the waterproof sheet 40 while ensuring an opening area that is necessary for the opening section 44 to maintain an electrical performance. Therefore, the opening area of the opening section 44 is increased and the adhesive area of the waterproof sheet 40 is also increased. Thus, the electrical performance of the crimp terminal 10B is improved and a fixing force of the waterproof sheet 40 can be also increased.

Therefore, in the waterproof sheet 40 according to the third embodiment, the adhesive area is increased from that of the front sheet section 31A of the waterproof sheet 30A which does not have the swelling section 45 according to the second embodiment described above. Thus, when peeling a remained portion of the punched waterproof sheet 40 when machining the sheet, specifically, it is possible to prevent the front sheet section 41 of which the adhesive area is smaller than that of the rear sheet section 43 from being peeled together with the remained portion.

Furthermore, the adhesive layer 54 that is exposed by peeling the peeling sheet 60 in one surface of the waterproof sheet 40 is attached to the inner surface of the wire connection section 20 and it is possible to the front sheet section 41 from being peeled together with the peeling sheet 58 when peeling the peeling sheet 58.

Fourth Embodiment

Now, referring to the drawings, a fourth embodiment will be described below. The same component members as those of the above described embodiments are designated by the same reference numerals and a detailed explanation thereof will be omitted.

The wire connection section 20 has a conductor crimp section 21 in a position of the front side, which is crimped onto a conductor exposed section Wap in which the conductor Wa is exposed by removing a cover Wb of the end portion of the wire W. The wire connection section 20 has a cover crimp section 22 in a position of a rear side thereof, which is crimped onto a portion to which the cover Wb remained in the end portion of the wire W is attached through a joint section 23. The joint section 23 connects the conductor crimp section 21 and the cover crimp section 22 so that an upper end of the conductor crimp section 21 on the rear side is continuous to an upper end of the cover crimp section 22 on the front side. The conductor crimp section 21 and the cover crimp section 22 are respectively formed in sizes corresponding to a diameter of the conductor exposed section Wap or a diameter of the portion to which the cover Wb is attached.

The conductor crimp section 21 and the cover crimp section 22 have a common bottom plate section 25 and a pair of left and right common caulking pieces 26 and 27. The caulking pieces 26 and 27 are erected upwardly from left and right side edges of the common bottom plate section 25, and caulk the conductor exposed section Wap and the portion to which the cover Wb is attached by being bent inwardly so as to surround the conductor exposed section Wap and the portion to which the cover Wb is attached of the wire W in a state where the conductor exposed section Wap and the portion to which the cover Wb is attached come into pressed contact with an upper surface of the bottom plate section 25. The conductor crimp section 21, the cover crimp section 22, and the joint section 23 are formed having a cross section of a U shape that is continuous from a front end of the conductor crimp section 21 to a rear end of the cover crimp section 22. Furthermore, the wire connection section 20 is configured having a length continuously and integrally covering from a portion on the front side from a front end Wap1 of the conductor exposed section Wap to a portion on the rear side from a front end Wb1 of the portion to which the cover Wb is attached, in a state of being crimped onto the end portion of the wire W.

Furthermore, a protruded strip 29 is formed in the conductor crimp section 21 along an inner peripheral surface having a cross section of a U shape. The protruded strip 29 is formed by punching the conductor crimp section 21 from an outer surface. When the end portion of the wire W that is peeled (a predetermined length of the cover Wb is peeled) is disposed on the upper surface of the bottom plate section 25 of the wire connection section 20, the protruded strip 29 is formed in a position that is the front side from the front end Wap1 of the conductor exposed section Wap. Furthermore, when the waterproof sheet 30 is disposed in the wire connection section 20, the protruded strip 29 is formed so as to be positioned between the front end 30*a* of the waterproof sheet 30 and the front end Wap1 of the conductor exposed section Wap. When crimping the conductor crimp section 21 onto the conductor exposed section Wap, the protruded strip 29 serves to prevent plastic deformation (elongation) in the front of the front end Wap1 of the conductor exposed section Wap.

Figure 13:
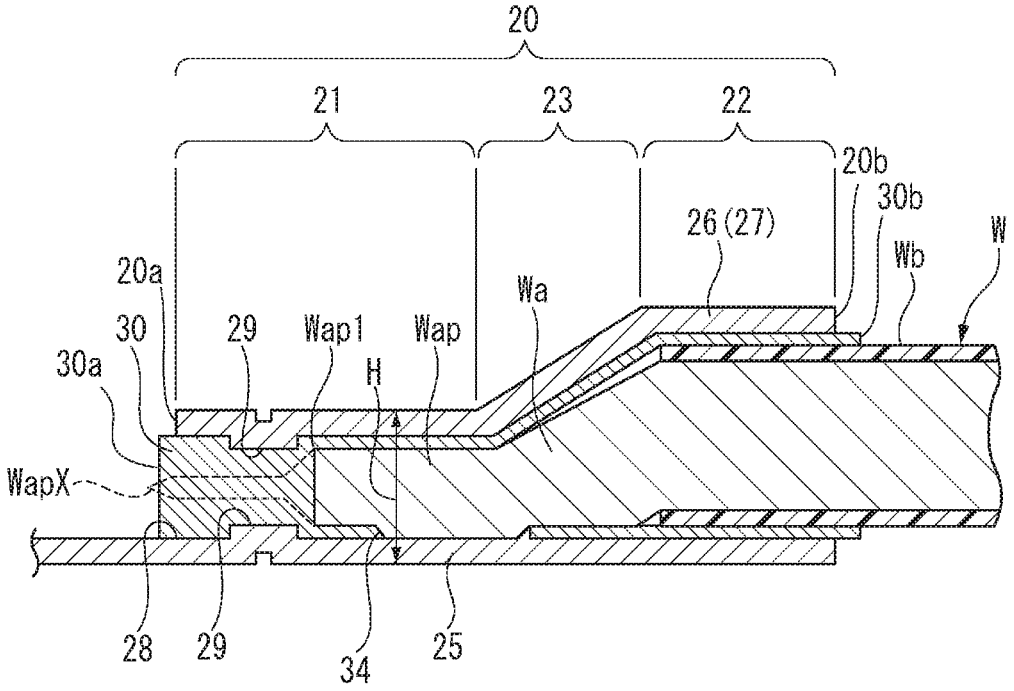
FIG. 13 is a vertical cross-sectional view of the connection structure of the crimp terminal with respect to the wire illustrated in FIG. 12.
Figure 14:
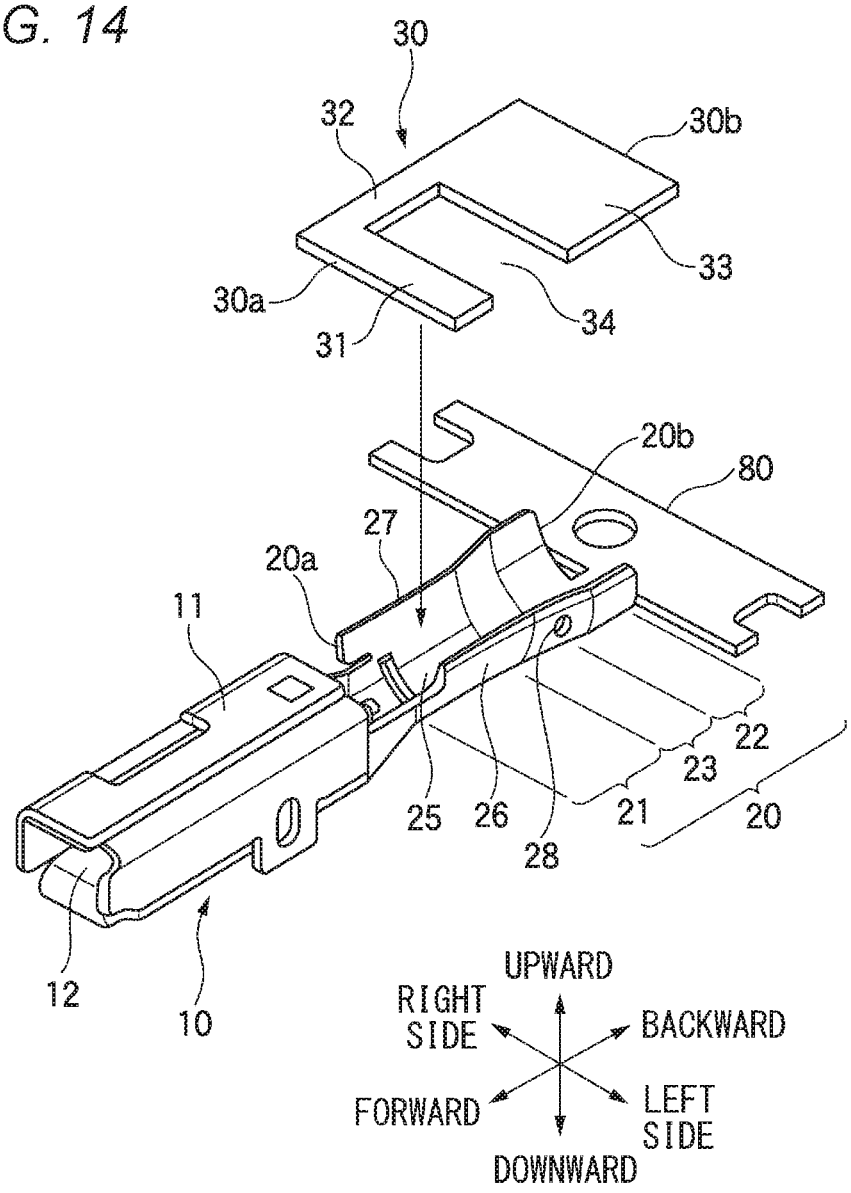
FIG. 14 is an explanatory view describing the connection structure of the crimp terminal with respect to a wire of the fifth embodiment of the invention and a perspective view illustrating an aspect in which the waterproof sheet is disposed in the wire connection section of the crimp terminal.
Figure 15:
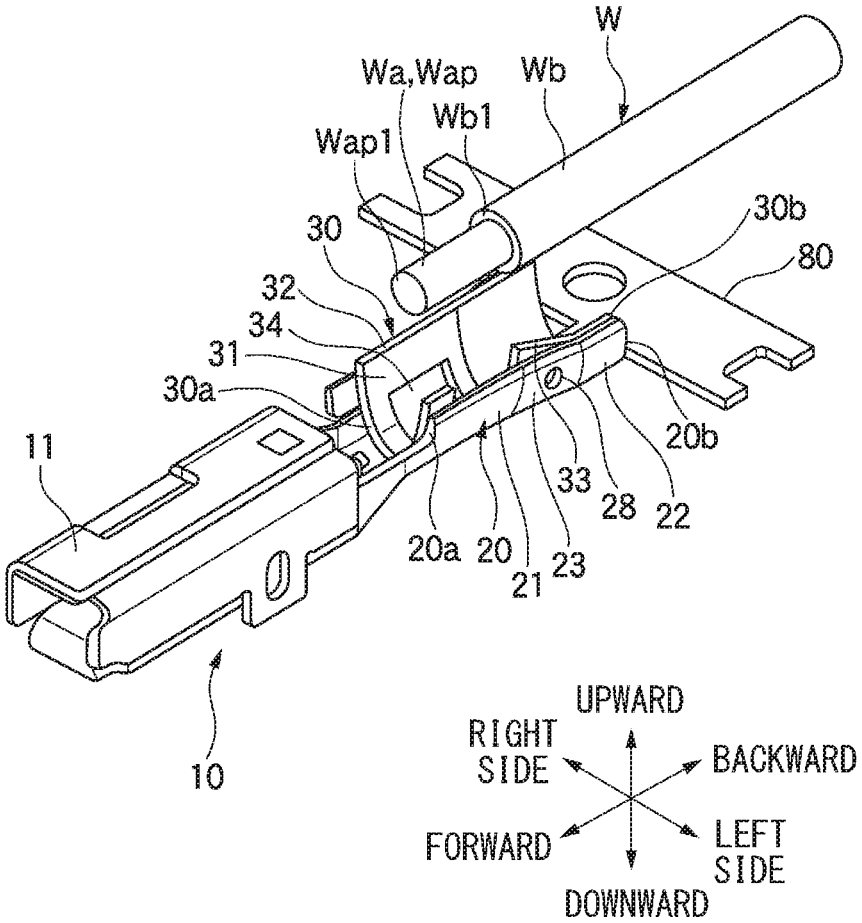
FIG. 15 is an explanatory view describing the connection structure of the crimp terminal with respect to the wire of the fifth embodiment of the invention and a perspective view illustrating an aspect in which the end portion of the wire is disposed in the wire connection section of the crimp terminal from above the waterproof sheet as the next process of FIG. 14.

Furthermore, as illustrated in FIG. 13, the protruded strip 29 is formed positioning on the rear end side from the front end of the conductor crimp section 21. Thus, an enlarged diameter section 28 is provided, of which a diameter is wider in the front end of the conductor crimp section 21 on the further front end side than in the position in which the protruded strip 29 is formed.

Then, the connection structure of the crimp terminal 10 with respect to the wire W is realized with the following sequence.

Figure 9:
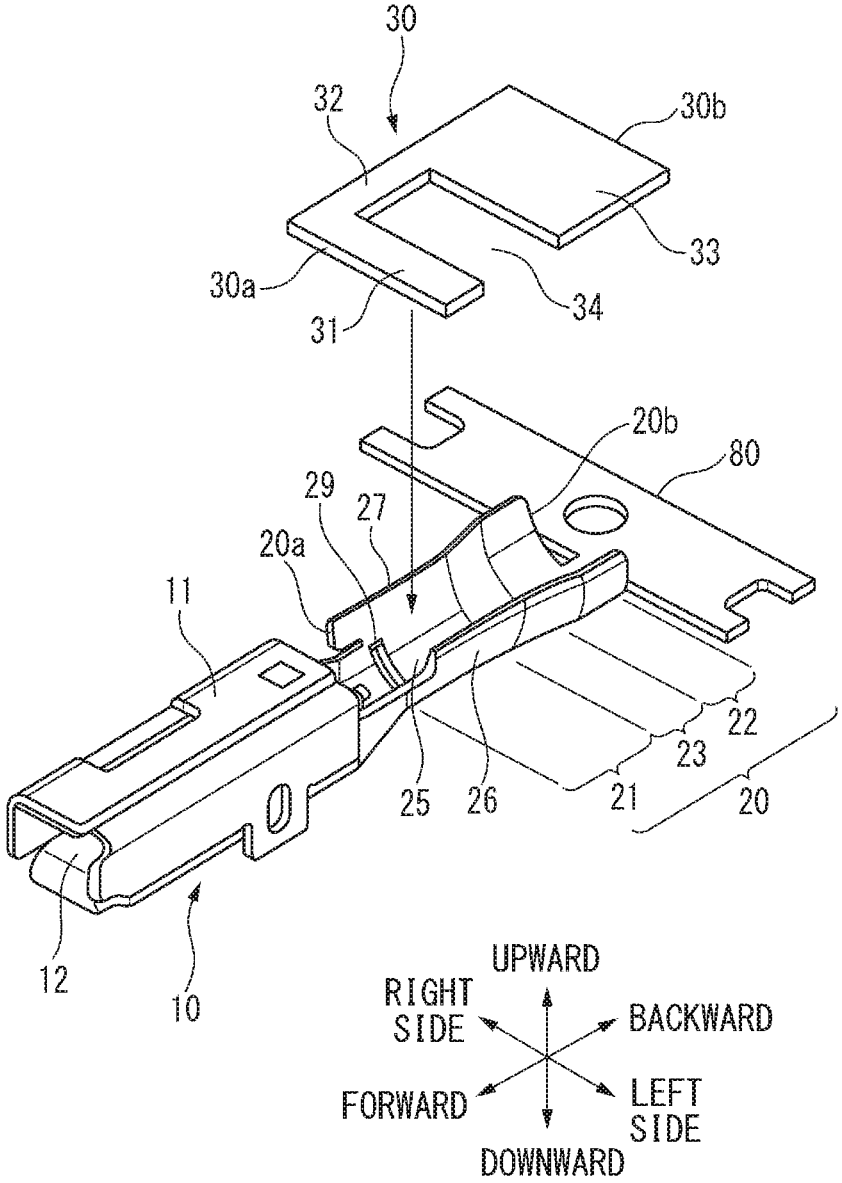
FIG. 9 is an explanatory view describing a connection structure of a crimp terminal with respect to a wire of a fourth embodiment of the invention and a perspective view illustrating an aspect in which a waterproof sheet is disposed in a wire connection section of the crimp terminal.
Figure 10:
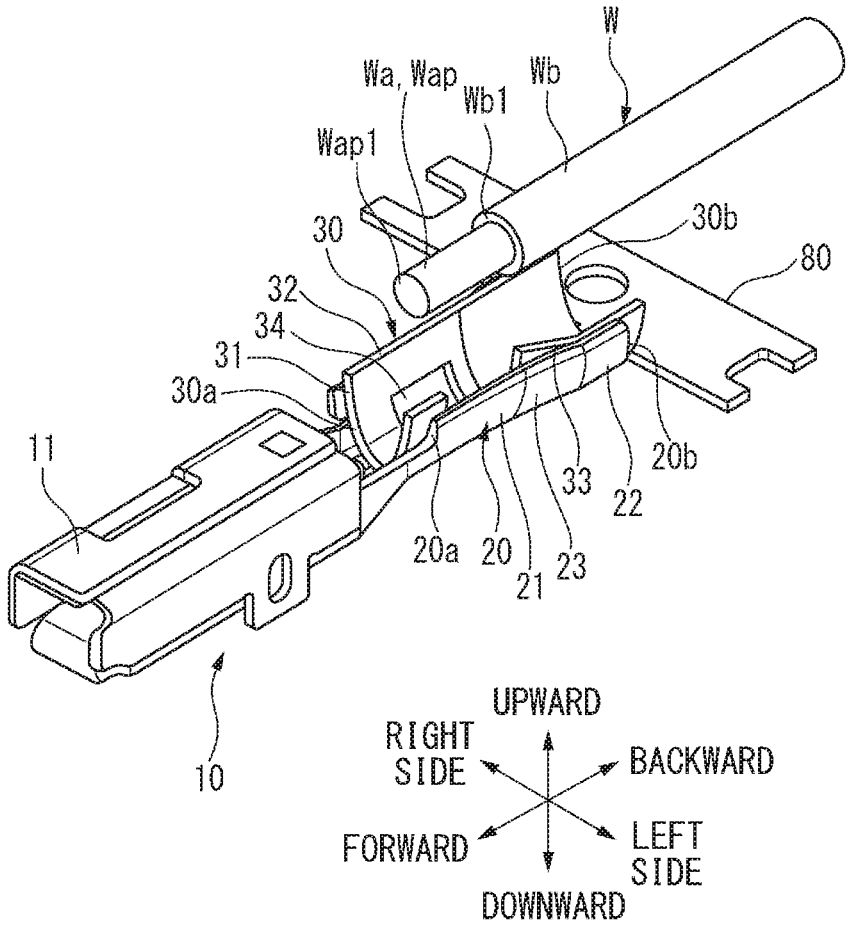
FIG. 10 is an explanatory view describing the connection structure of the crimp terminal with respect to the wire of the fourth embodiment of the invention and a perspective view illustrating an aspect in which an end portion of the wire is disposed in the wire connection section of the crimp terminal from above the waterproof sheet as the next process of FIG. 9.

First, as illustrated in FIGS. 9 and 10, the waterproof sheet 30 having the opening section 34 in a position corresponding to the conductor exposed section Wap is disposed in the inner surface of the wire connection section 20 of the crimp terminal 10, which has a cross section of a U shape.

That is, as illustrated in FIG. 9, the waterproof sheet 30 is formed in a U shape or a rectangular shape (not illustrated) depending on a position of the opening section 34. The waterproof sheet 30 has a front sheet section 31 that is extended in a width direction of the wire connection section 20 in a position of the front side from the opening section 34 and has a rear sheet section 33 that is extended in the width direction of the wire connection section 20 in a position of the rear side from the opening section 34. Furthermore, the waterproof sheet 30 has a side sheet section 32 joining the front sheet section 31 and the rear sheet section 33 in a position of a side of the opening section 34.

Furthermore, the waterproof sheet 30 is formed having a length such that a front end 30*a* and a rear end 30*b* of the waterproof sheet 30 protrude from a front end 20*a* and a rear end 20*b* of the wire connection section 20 to the outside, when the wire connection section 20 is crimped onto the end portion of the wire VV. Specifically, the waterproof sheet 30 is formed having a length such that the front end 30*a* of the front sheet section 31 is positioned on the front side from the front end 20*a* of the conductor crimp section 21 and the rear end 30*b* of the rear sheet section 33 is positioned on the rear side from the rear end 20*b* of the cover crimp section 22. The waterproof sheet 30 is a both-surface adhesive sheet in which adhesive layers are provided on both surfaces of a base sheet. Then, a peeling sheet is provided in each adhesive layer of the waterproof sheet 30 through a peeling layer before using.

Thus, the waterproof sheet 30 is attached to the inner surface of the wire connection section 20 by the adhesive layer that is exposed by peeling the peeling sheet in one surface of the waterproof sheet 30.

Figure 11:
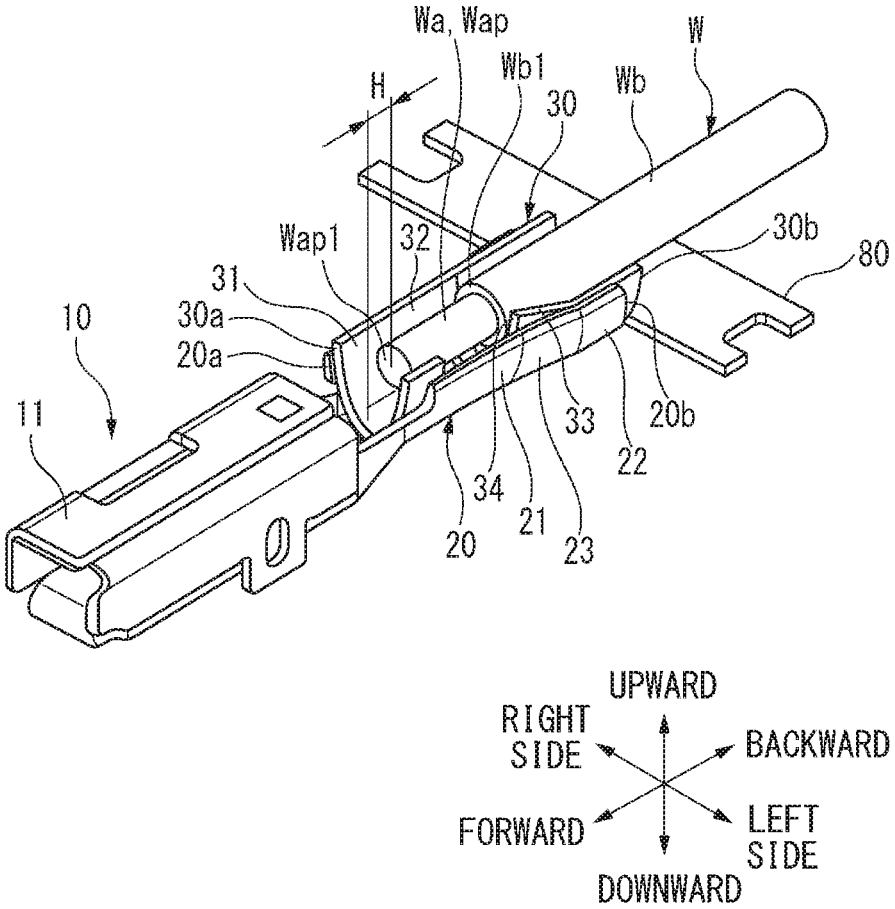
FIG. 11 is an explanatory view describing the connection structure of the crimp terminal with respect to the wire of the fourth embodiment of the invention and a perspective view illustrating a position where the conductor exposed section is disposed when disposing the end portion of the wire is in the wire connection section of the crimp terminal from above the waterproof sheet.

After the waterproof sheet 30 is disposed in the inner surface of the wire connection section 20, the adhesive layer is exposed by peeling the peeling sheet in the other surface of the waterproof sheet 30 and then the end portion of the wire W that is peeled (a predetermined length of the cover Wb is peeled) is disposed on the upper surface of the bottom plate section 25 of the wire connection section 20. At this time, as illustrated in FIG. 11, the end portion of the wire W is disposed on the upper surface of the bottom plate section 25 of the wire connection section 20 such that the front end Wap1 of the conductor exposed section Wap is positioned on the rear side from the protruded strip 29 (see FIGS. 9 and 13) and on the rear side from the front end 30*a* of the waterproof sheet 30 by a dimension H, and the front end Wb1 of the portion to which the cover is attached is positioned on the front side from the rear end 30*b* of the waterproof sheet 30 and on the front side from the rear end 20*b* of the wire connection section 20.

Figure 12:
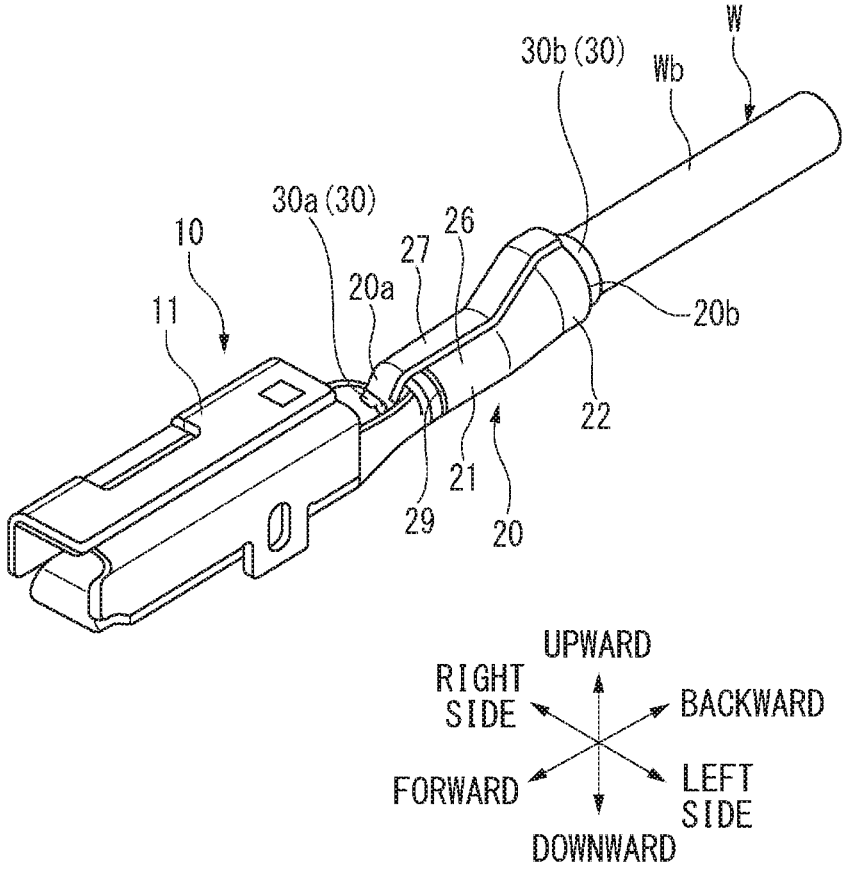
FIG. 12 is an external perspective view of the connection structure of the crimp terminal with respect to the wire of the fourth embodiment of the invention.

Then, in this state, as illustrated in FIG. 12, the wire connection section 20 is crimped onto the end portion of the wire W. That is, the left and right caulking pieces 26 and 27 are caulked by inwardly bending sequentially so as to surround the end portion of the wire W and the other caulking piece 27 is overlapped on an end portion of one caulking piece 26.

By carrying out caulking as such, the conductor crimp section 21 of the crimp terminal 10 and the conductor exposed section Wap of the wire W are electrically connected to each other through the opening section 34 formed in the waterproof sheet 30, and the front and rear of the connection portion between the conductor crimp section 21 and the conductor exposed section Wap are closed by the waterproof sheet 30. At this time, a portion that is caulked by the protruded strip 29, that is, the front from the front end Wap1 of the conductor exposed section Wap is filled by the waterproof sheet in the inside of the conductor crimp section 21. Furthermore, the front end 30*a* and the rear end 30*b* of the waterproof sheet 30 are protruded from the front end 20*a* and the rear end 20*b* of the wire connection section 20 to the outside. As described above, the connection structure of the embodiment of the invention is completed.

As described above, according to the crimp terminal 10 of the embodiment, as illustrated in FIG. 13, by the protruded strip 29 formed in the conductor crimp section 21, it is possible to prevent the front end Wap1 of the conductor exposed section Wap from extending forward and protruding from the waterproof sheet 30 when crimping the wire connection section 20. Thus, it is possible to reliably surround the conductor exposed section Wap by the waterproof sheet 30 and it is possible to ensure a reliable waterproof performance.

For example, if the protruded strip 29 does not exist, or if the crimping is performed in a state where the front end Wap1 of the conductor exposed section Wap enters to the position of the protruded strip 29, as indicated in a dotted line WapX in FIG. 13, there is a concern that the conductor exposed section Wap extends forward and protrudes from the waterproof sheet 30. As described above, when the conductor exposed section Wap protrudes from the waterproof sheet 30, there is a concern that water is infiltrated from the outside into the inside thereof through a gap between wires configuring the conductor Wa. On the other hand, the protruded strip 29 is provided as the embodiment of the invention so that it is possible to hold the extension of the conductor exposed section Wap forward by the protruded strip 29. Thus, it is possible to prevent the conductor exposed section Wap from protruding from the waterproof sheet 30. Thus, it is possible to ensure a reliable waterproof performance. Therefore, even if the crimp terminal 10 is configured of different kinds of metals with respect to the conductor Wa of the wire W, the electrolytic solution is not supplied between the different kinds of metals. Thus, galvanic corrosion is suppressed that may occur in the conductor Wa made of aluminum or an aluminum alloy that is crimped onto the conductor crimp section 21 made of copper or a copper alloy.

Furthermore, since the conductor exposed section Wap is not protruded to the front by the existence of the protruded strip 29, it is possible to close the front of the conductor exposed section Wap with the waterproof sheet 30 only by caulking the conductor exposed section Wap round inwardly by the pair of left and right common caulking pieces 26 and 27 of the wire connection section 20 so as to surround the end portion of the wire W. Thus, it is not necessary to add the crushing process to close the opening generated in the front of conductor exposed section after the caulking process as the related art and the reduction of man-hours and processing costs is achieved, accordingly.

Furthermore, even if the height H of the caulking is high in a tolerance range by manufacturing variations of the conductor crimp section 21, since the protruded strip 29 reliably bites the waterproof sheet 30, it is possible to reliably hold the waterproof sheet 30 that may move forward when crimping.

According to the connection structure of the crimp terminal 10 with respect to the wire W, the front and rear of the portion in which the conductor exposed section Wap of the wire W is connected to the conductor crimp section 21 through the opening section 34 of the waterproof sheet 30 can be completely closed with the waterproof sheet 30. Thus, it is possible to ensure a reliable waterproof performance while ensuring the electrical connection performance between the crimp terminal 10 and the wire W.

Furthermore, the front of the conductor exposed section Wap can be closed with the waterproof sheet 30 only by caulking the conductor exposed section Wap round inwardly by the pair of left and right common caulking pieces 26 and 27 of the wire connection section 20 so as to surround the end portion of the wire W. Thus, it is not necessary to add the crushing process to close the opening generated in the front of conductor exposed section Wap after the caulking process and the reduction of man-hours and processing costs is achieved, accordingly.

Furthermore, in a state after the wire W is crimped, since the front end 30*a* and the rear end 30*b* of the waterproof sheet 30 protrude from the front end 20*a* and the rear end 20*b* of the wire connection section 20, it is possible to immediately confirm the presence or absence, abnormality of the assembled state, or the like of the assembly of the waterproof sheet 30 when viewed from the outside. Thus, it is possible to easily determine the guarantee of waterproof performance.

Furthermore, the front end side of the conductor crimp section 21 on the front end side from the position in which the protruded strip 29 is formed is the enlarged diameter section 28 and it is possible to prevent the waterproof sheet 30 that is extruded by the protruded strip 29 from widening to the front when crimping by the wire connection section 20. That is, if the height H of the caulking is low in the tolerance range by manufacturing variations of the conductor crimp section 21, the waterproof sheet 30 extruded to the front by the protruded strip 29 is widened to the front and it is possible to reduce seal performance of the front of the conductor exposed section Wap. However, according to the configuration, the enlarged diameter section 28 of the front end side of the conductor crimp section 21 can suppress the waterproof sheet 30 from widening to the front. Accordingly, since it is possible to cope with manufacturing variations by the existence of the enlarged diameter section 28 that is configured on the front end side from the protruded strip 29 of conductor crimp section 21 when crimping, it is possible to safely ensure a high waterproof performance by the waterproof sheet 30.

Furthermore, since the waterproof sheet 30 is attached to the inner surface of the wire connection section 20 by the adhesive layer, there is no concern that the waterproof sheet 30 is deviated when crimping and it is possible to increase waterproof reliability.

Furthermore, since the adhesive layer is also provided in the surface of the waterproof sheet 30 coming into contact with the wire W, there is no concern that the wire W is deviated when crimping and the improvement of crimping quality can be achieved.

More specifically, the following advantages are achieved by providing the adhesive layer in the one surface of the waterproof sheet 30 and attaching one surface of the waterproof sheet 30 to the inner surface of the wire connection section 20 and providing the adhesive layer also in the other surface of the waterproof sheet 30, and adhering the other surface thereof to the cover Wb of the wire W.

In the situation before the crimp terminal 10 is crimped onto the end portion of the wire W, the waterproof sheet 30 disposed with respect to the wire connection section 20 is difficult to move by the adhesive layer of one surface of the waterproof sheet 30 and the wire W disposed with respect to the waterproof sheet is difficult to move by the adhesive layer of the other surface of the waterproof sheet 30. As described above, arrangement positions of the wire connection section 20, the waterproof sheet 30, and the wire W are stably fixed and thus it is possible to prevent connection failure due to the position deviations of the members when crimping.

Furthermore, the wire W extends in the longitudinal direction and then the cross section of the wire W may be thin in the high temperature environment. If the adhesive layer is not provided in the waterproof sheet, the cross section of the wire is thin and thereby there is a concern that the gap is formed between the waterproof sheet and the cover. However, if the adhesive layers are provided in both surfaces of the waterproof sheet 30, the waterproof sheet 30 is deformed following the deformation of the wire W, even if the wire W is thin in the end portion of the wire W onto which the crimp terminal 10 is crimped. Thus, it is possible to prevent the gap from forming between the wire connection section 20 and the waterproof sheet 30, and between the waterproof sheet 30 and the cover Wb. Thus, infiltration of water into the crimp terminal 10 through between the wire connection section 20 and the waterproof sheet 30, and between the waterproof sheet 30 and the cover Wb is prevented so that the improvement of the waterproof performance is achieved.

Furthermore, in the crimp terminal 10, the caulking pieces 26 and 27 of the caulked wire connection section 20 may be opened slightly in a direction in which a holding force of the caulking pieces 26 and 27 is weakened with lapse of time. If the adhesive layer is not provided in the waterproof sheet, there is a concern that the gap is formed between the wire connection section and the waterproof sheet by opening of the caulking pieces. However, if the adhesive layers are provided in both surfaces of the waterproof sheet 30, the waterproof sheet 30 bonded to the cover Wb gives stress to the caulking pieces 26 and 27, which resists the deformation of the caulking pieces 26 and 27, even if the caulking pieces 26 and 27 of the caulked wire connection section 20 are about to be opened. Thus, it is possible to prevent the gap from occurring between the wire connection section 20 and the waterproof sheet 30, and between the waterproof sheet 30 and the cover Wb. Thus, infiltration of water into the crimp terminal 10 through between the wire connection section 20 and the waterproof sheet 30, and between the waterproof sheet 30 and the cover Wb is prevented so that the improvement of the waterproof performance is achieved.

Moreover, the invention is not limited to the configuration in which the adhesive layers are provided in the both surfaces of the waterproof sheet 30. The adhesive layer may be provided in one surface or the other surface of the waterproof sheet 30 described above. Even if the adhesive layer is provided in any one of the surfaces of the waterproof sheet 30, advantages such as prevention of the connection failure when crimping and the improvement of the waterproof performance are achieved. Furthermore, the configuration is not limited to the adhesive sheet such as the waterproof sheet 30 described above in which the adhesive layer is provided in the base sheet. A waterproof sheet in which adhesive is applied to one surface of a butyl sheet or a base material sheet may be attached to the inner surface of the wire connection section 20.

Fifth Embodiment

Now, referring to the drawings, a fifth embodiment will be described below. The same component members as those of the above described embodiments are designated by the same reference numerals and a detailed explanation thereof will be omitted.

As shown in FIGS. 14 to 17, the joint section 23 is provided between the conductor crimp section 21 and the cover crimp section 22 so as to cover the rear end of the conductor exposed section Wap, that is, the side of the front end Wb1 of the cover Wb remained in the end portion of the wire W. A confirmation window 28 that is formed of a small through hole passing through the inner surface from the outer surface of the wire connection section 20 is provided in the joint section 23. The confirmation window 28 is provided for confirming a state (specifically, a state of the waterproof sheet 30 described below) of the inside of the wire connection section 20, in a state where the crimp terminal 10 is crimped onto the end portion of the wire W. The confirmation window 28 is provided in a position in which the crimping of the conductor crimp section 21 with respect to the conductor exposed section Wap and the crimping of the cover crimp section 22 with respect to the cover Wb remained in the end portion of the wire W are not affected.

Furthermore, the waterproof sheet 30 is formed having a length such that the front end 30*a* and the rear end 30*b* of the waterproof sheet 30 do not protrude from the front end 20*a* and the rear end 20*b* of the wire connection section 20 to the outside, when the wire connection section 20 is crimped onto the end portion of the wire W. Specifically, the waterproof sheet 30 is formed having a length such that the front end 30*a* of the front sheet section 31 is positioned on the rear side from the front end 20*a* of the conductor crimp section 21 and the rear end 30*b* of the rear sheet section 33 is positioned on the front side from the rear end 20*b* of the cover crimp section 22. Similar to the first embodiment described above, the waterproof sheet 30 may be attached to the inner surface of the wire connection section 20 by applying the adhesive to one surface of the waterproof sheet 30.

Figure 16:
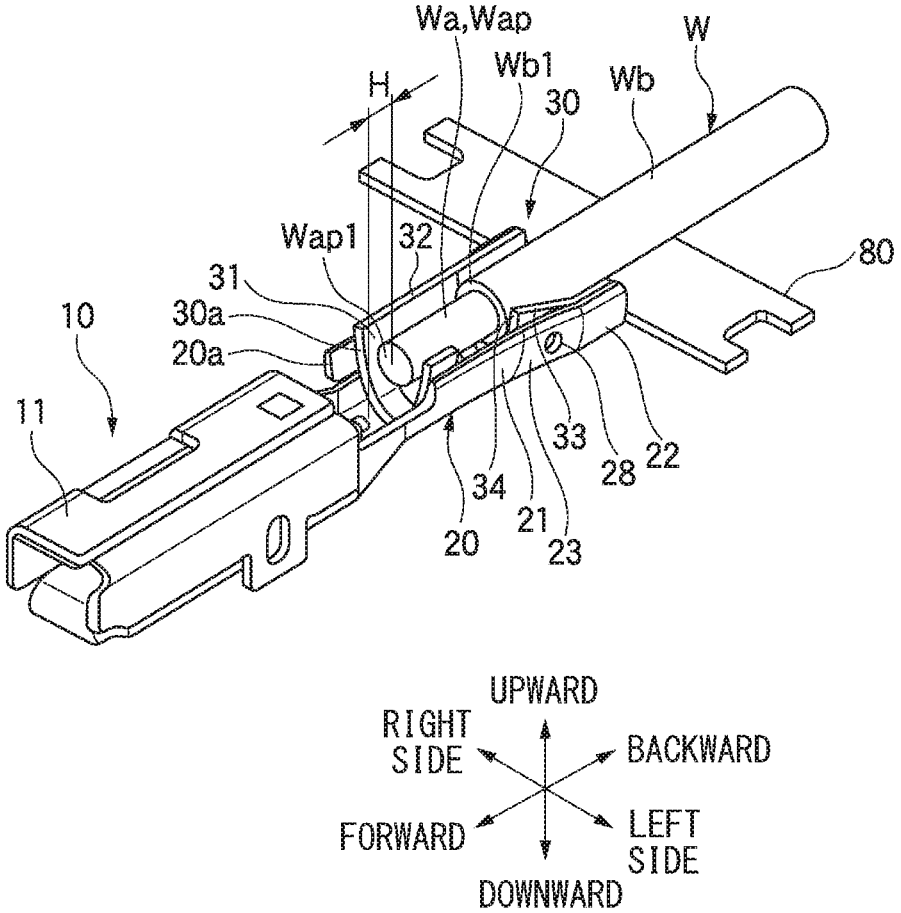
FIG. 16 is an explanatory view describing the connection structure of the crimp terminal with respect to the wire of the fifth embodiment of the invention and a perspective view illustrating a position where the conductor exposed section is disposed when disposing the end portion of the wire is in the wire connection section of the crimp terminal from above the waterproof sheet.

After the waterproof sheet 30 is disposed in the inner surface of the wire connection section 20, the end portion of the wire W that is peeled (a predetermined length of the cover Wb is peeled) is disposed on the upper surface of the bottom plate section 25 of the wire connection section 20. At this time, as illustrated in FIG. 16, the end portion of the wire W is disposed on the upper surface of the bottom plate section 25 of the wire connection section 20 so that the front end Wap1 of the conductor exposed section Wap is positioned on the rear side from the front end 30*a* of the waterproof sheet 30 by the dimension H and the front end Wb1 of the portion to which the cover is attached is positioned on the front side from the rear end 30*b* of the waterproof sheet 30 and on the front side from the rear end 20*b* of the wire connection section 20.

Figure 17:
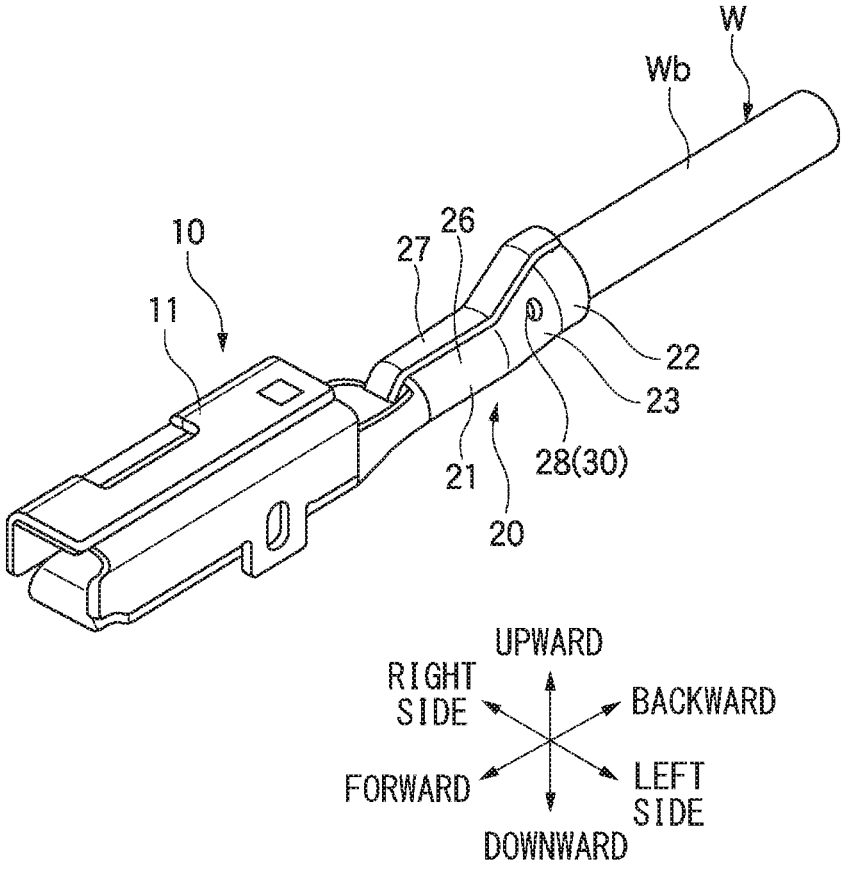
FIG. 17 is an external perspective view of the connection structure of the crimp terminal with respect to the wire of the fifth embodiment of the invention.

Then, in this state, as illustrated in FIG. 17, the wire connection section 20 is crimped onto the end portion of the wire W. That is, the left and right caulking pieces 26 and 27 are caulked by inwardly bending sequentially and the end portion of the other caulking piece 27 is overlapped on the end portion of one caulking piece 26 so as to surround the end portion of the wire W.

By carrying out caulking as such, the conductor crimp section 21 of the crimp terminal 10 and the conductor exposed section Wap of the wire W are electrically connected to each other through the opening section 34 formed in the waterproof sheet 30. Furthermore, in this state, the waterproof sheet 30 inside thereof is visible through the confirmation window 28 formed in the joint section 23 of the wire connection section 20 and the connection structure of the embodiment is completed.

As described above, according to the connection structure of the crimp terminal 10 with respect to the wire W of the embodiment of the invention, it is possible to confirm the presence or absence, abnormality of the assembled state, or the like of the assembly of the waterproof sheet 30 that is disposed in the inner surface of the wire connection section 20 to ensure the waterproof performance from outside through the confirmation window 28. Thus, it is possible to easily determine the guarantee of waterproof performance.

Furthermore, since the presence or absence of the waterproof sheet 30 can be confirmed through the confirmation window 28, for example, it is possible to set the length of the waterproof sheet 30 to be short compared to a case where the waterproof sheet 30 is formed long so as to be extruded from the front end 20*a* and the rear end 20*b* of the wire connection section 20, and the waterproof sheet 30 is confirmed by the presence or absence of the waterproof sheet 30 that is extruded from the wire connection section 20. Thus, a necessary amount of the waterproof sheet 30 can be reduced.

Furthermore, according to the connection structure of the crimp terminal 10 with respect to the wire W of the embodiment of the invention, the front and rear of the portion in which the conductor exposed section Wap of the wire W is electrically connected to the conductor crimp section 21 through the opening section 34 of the waterproof sheet 30 can be completely closed with the waterproof sheet 30. Thus, it is possible to ensure reliable waterproof performance while ensuring the electrical connection performance between the crimp terminal 10 and the wire W.

Furthermore, the front of the conductor exposed section Wap can be closed with the waterproof sheet 30 only by caulking the conductor exposed section Wap round inwardly by the pair of left and right caulking pieces 26 and 27 of the wire connection section 20 so as to surround the end portion of the wire W. Thus, it is not necessary to add the crushing process to close the opening generated in the front of conductor exposed section Wap after the caulking process and the reduction of the man-hours and processing costs is achieved, accordingly.

Furthermore, since the waterproof sheet 30 is attached to the inner surface of the wire connection section 20 by the adhesive layer, there is no concern that the waterproof sheet 30 is deviated when crimping and it is possible to improve the waterproof reliability.

Sixth Embodiment

Figure 18:
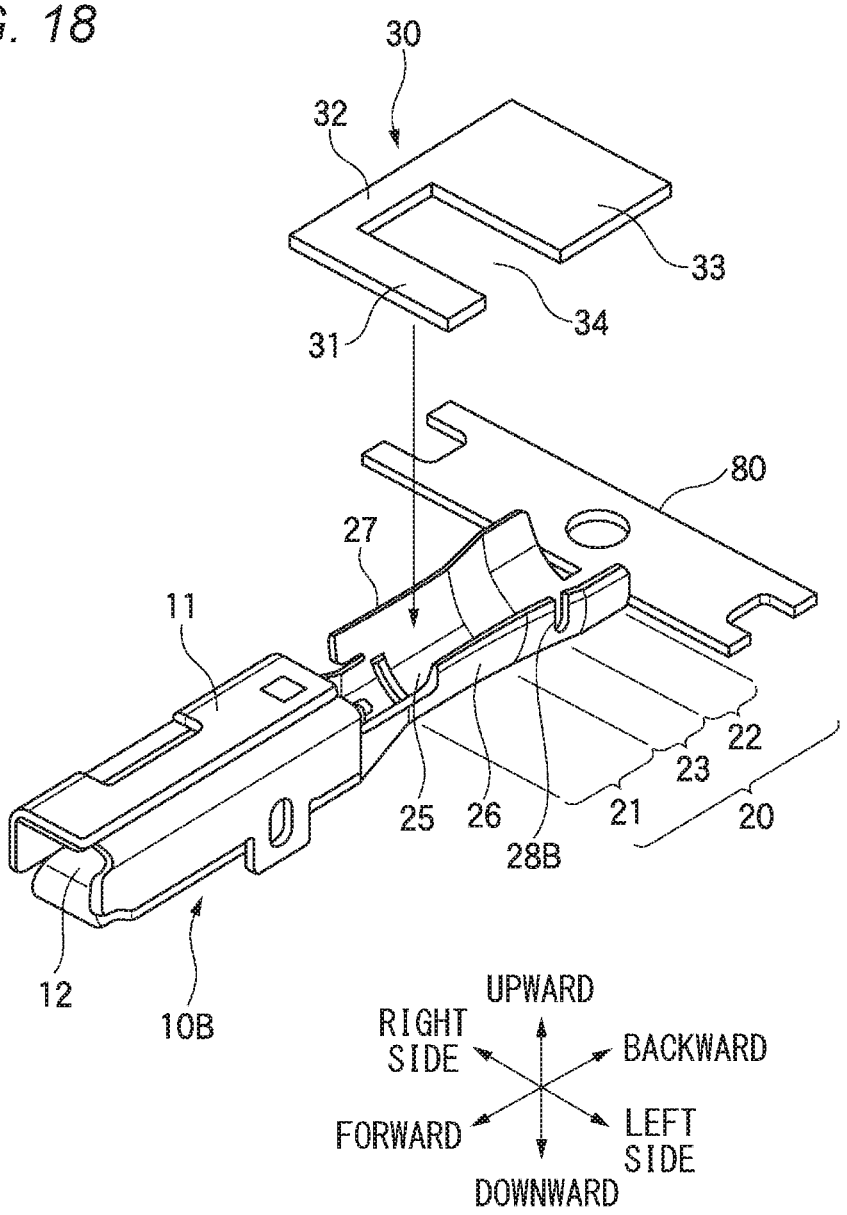
FIG. 18 is an explanatory view describing the connection structure of the crimp terminal with respect to a wire of the sixth embodiment of the invention and a perspective view illustrating an aspect in which the waterproof sheet is disposed in the wire connection section of the crimp terminal.
Figure 19:
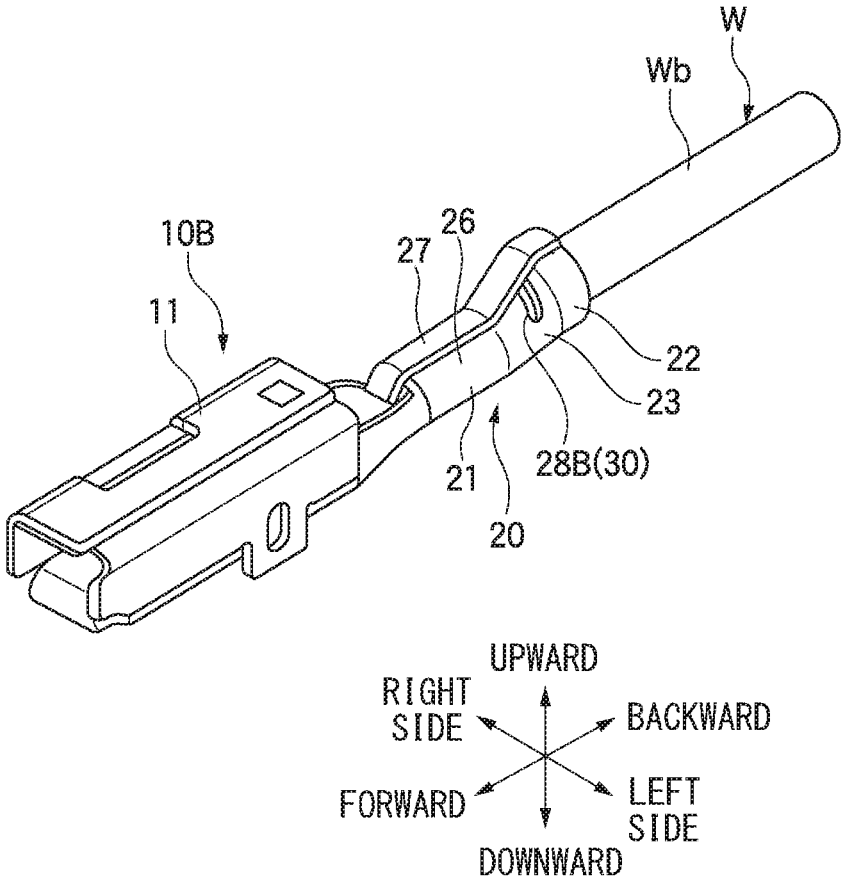
FIG. 19 is an external perspective view of the connection structure of the crimp terminal with respect to the wire of the sixth embodiment of the invention.
Figure 20:
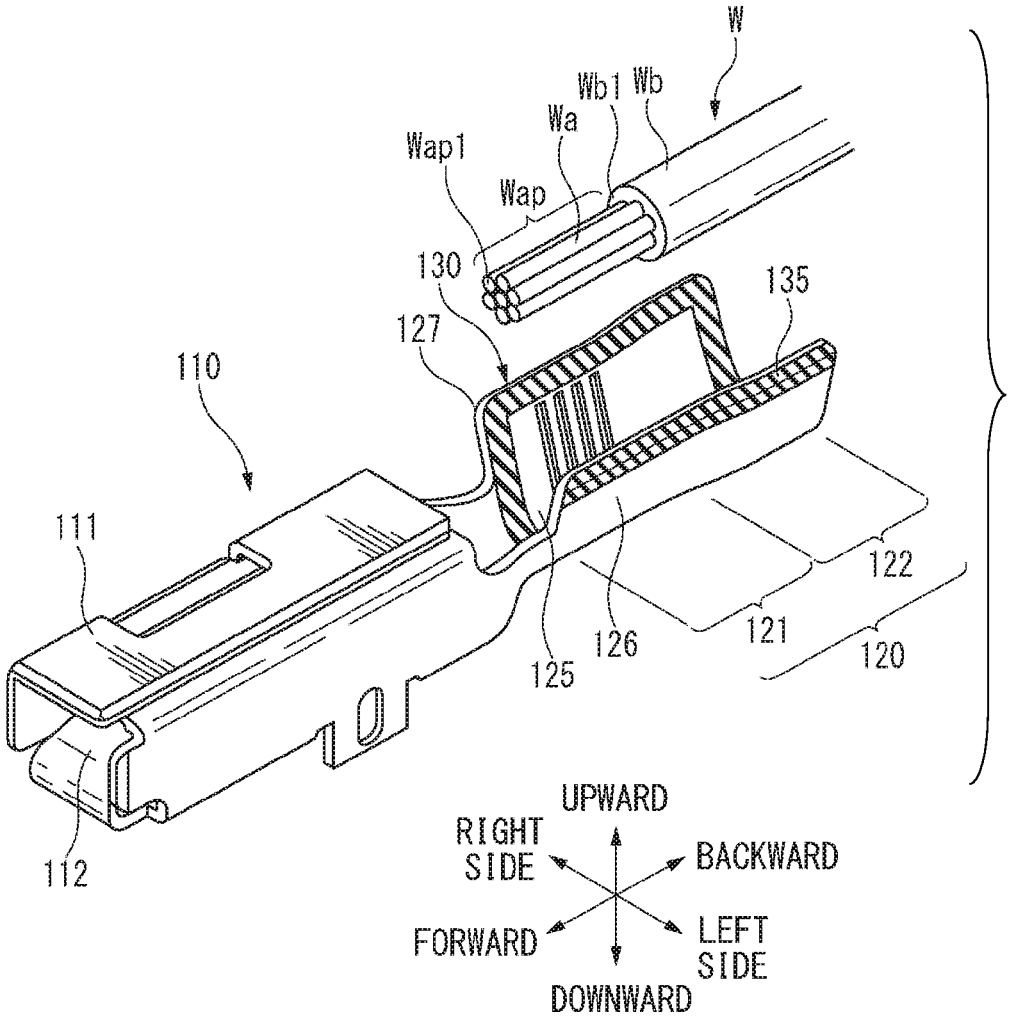
FIG. 20 is an explanatory view describing a connection structure of a crimp terminal with respect to a wire of the related art and a perspective view illustrating an aspect in which a waterproof sheet is disposed in a wire connection section of the crimp terminal and an end portion of the wire is disposed in the wire connection section of the crimp terminal.
Figure 21:
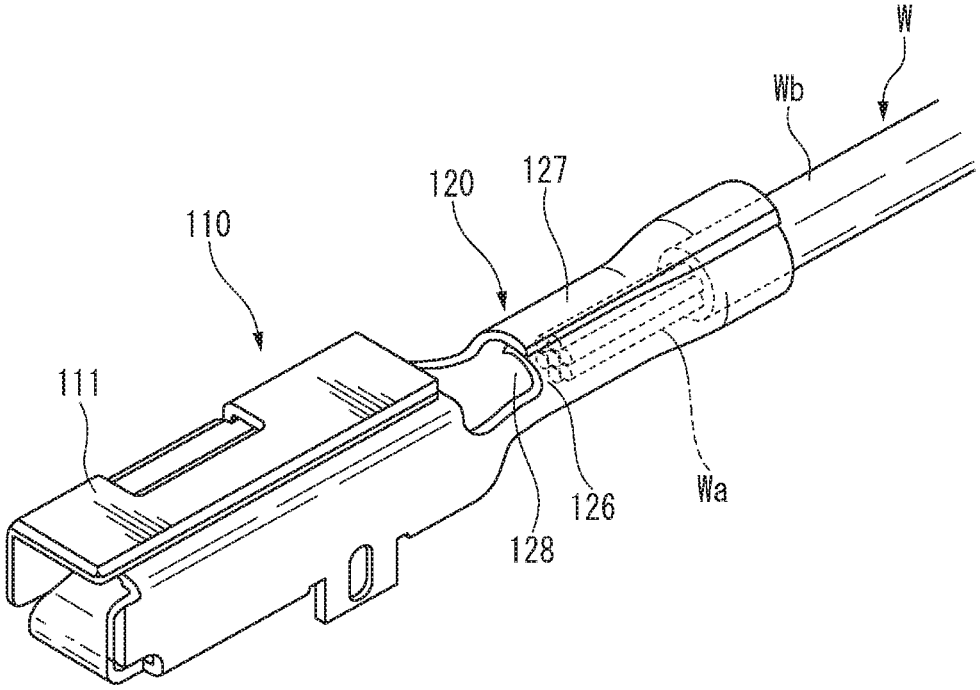
FIG. 21 is a perspective view illustrating a state where the wire connection section of the crimp terminal of the related art is caulked with respect to the wire.
Figure 22:
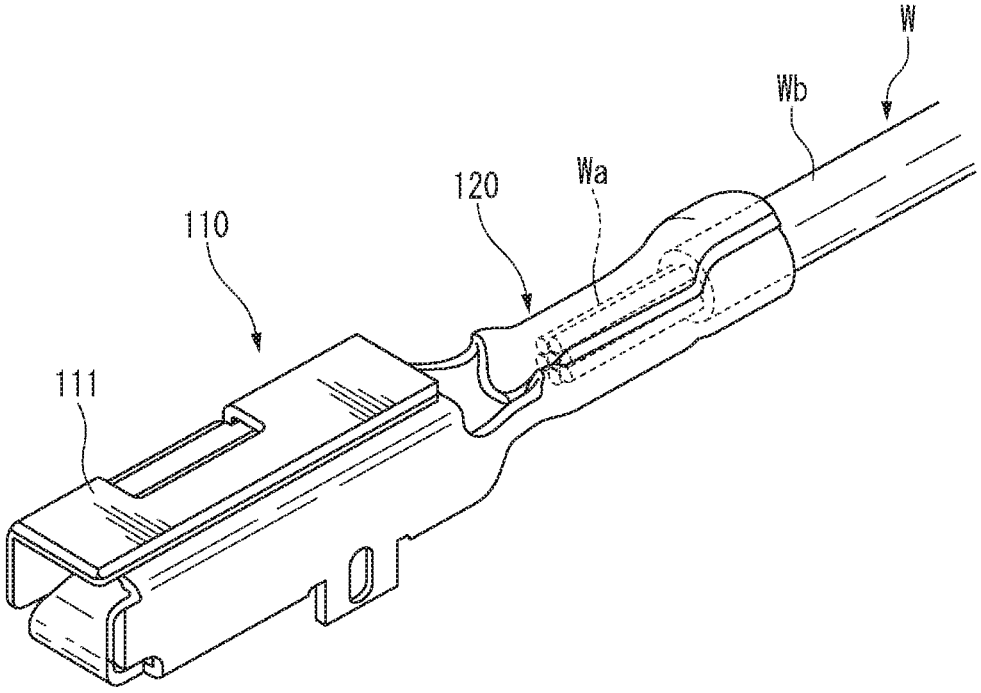
FIG. 22 is a perspective view illustrating a state where a connection structure is completed by crushing a front end of the wire connection section next to the process of FIG. 21.

A sixth embodiment of the invention will be described with reference to the drawings. FIG. 18 is an explanatory view describing a connection structure of a crimp terminal with respect to a wire of a sixth embodiment of the invention and a perspective view illustrating an aspect in which a waterproof sheet is disposed in a wire connection section of the crimp terminal. FIG. 19 is an external perspective view of the connection structure of the crimp terminal with respect to the wire of the sixth embodiment of the invention.

In the fifth embodiment described above, a case where the confirmation window 28 is configured of the small through hole is illustrated. As a crimp terminal 10B of the sixth embodiment illustrated in FIGS. 18 and 19, a confirmation window 28B may be configured of a slit provided in the joint section 23 of the wire connection section 20. In this case, the slit may be formed downward from the upper end of the caulking piece 26.

The invention is not limited to the embodiment described above and can be appropriately modified and improved. In addition, in the embodiment described above, the material, the shape, the dimension, the number, the arrangement position, and the like of each configuration element are arbitrary and are not limited as long as it can achieve the invention.

For example, if the adhesive layer is formed also in the surface of the waterproof sheet 30 coming into contact with the wire W, there is no concern that the wire W is deviated when crimping and improvement of crimping quality is achieved.

Furthermore, the embodiments in which the confirmation windows 28 and 28B are provided in the joint section 23 are described. The confirmation window can be appropriately provided in the wire connection section 20. At this time, it is preferable that the confirmation window 28 be provided in a position in which the crimping of the conductor crimp section 21 and the crimping of the cover crimp section 22 are not affected.

Here, features of embodiments of the connection structure of the crimp terminal with respect to the wire according to the invention described above are simply described below.

[1] A connection structure of a crimp terminal (10) with respect to a wire (W) including:

the wire (W) that has a conductor (Wa) and a cover (Wb) that covers the conductor (Wa); and a crimp terminal (10) of which an electrical connection section (11) that is electrically connected to a counterpart terminal is formed in a front portion and a wire connection section (20) that is crimped onto an end portion of the wire (W) is formed in a rear portion, in which the wire connection section (20) has a conductor crimp section (21) that is crimped onto a conductor exposed section (Wap) in which a conductor (Wa) is exposed by removing the cover (Wb) of the end portion of the wire (W) and a cover crimp section (22) that is crimped onto a part of the cover (Wb) remained in the end portion of the wire (W), and the conductor crimp section (21) is formed on the front side and the cover crimp section (22) is formed on the rear side, in which the wire connection section (20) of a state being crimped onto the end portion of the wire (W) covers from a portion on a front side from the front end (Wap1) of the conductor exposed section (Wap) to a portion on a rear side from a front end (Wb1) of a part of the cover (Wb), in which the connection structure further includes a waterproof sheet (30) that is disposed in an inner surface of the wire connection section (20) and has an opening section (34) in a position corresponding to the conductor exposed section (Wap), in which the waterproof sheet (30) is configured such that a front end (30*a*) of the waterproof sheet (30) is positioned on the front side from the front end (20*a*) of the conductor crimp section (21), and in which the wire connection section (20) of a state being crimped onto the end portion of the wire (W) is configured such that the conductor crimp section (21) and the conductor exposed section (Wap) are electrically connected to each other through the opening section (34) formed in the waterproof sheet (30), and front and rear portions of a connection portion between the conductor crimp section (21) and the conductor exposed section (Wap) are closed by the waterproof sheet (30).

[2] The connection structure of a crimp terminal (10) with respect to a wire (W) according to [1], in which the waterproof sheet (30) is attached to the inner surface of the wire connection section (20) by an adhesive layer (54) provided on a surface of a base sheet (52).

[3] The connection structure of a crimp terminal (10) with respect to a wire (W) according to [1], in which the adhesive layer (54) is provided in a surface with which the wire (W) comes into contact in the waterproof sheet (30).

[4] A connection structure of a crimp terminal (10) with respect to a wire (W) including:

the wire (W) that has a conductor (Wa) and a cover (Wb) that covers the conductor (Wa); and a crimp terminal (10) of which an electrical connection section (11) that is electrically connected to a counterpart terminal is formed in a front portion and a wire connection section (20) that is crimped onto an end portion of the wire (W) is formed in a rear portion, in which the wire connection section (20) has a conductor crimp section (21) that is crimped onto a conductor exposed section (Wap) in which a conductor (Wa) is exposed by removing the cover (Wb) of the end portion of the wire (W) and a cover crimp section (22) that is crimped onto a part of the cover (Wb) remained in the end portion of the wire (W), and the conductor crimp section (21) is formed on the front side and the cover crimp section (22) is formed on the rear side, in which the wire connection section (20) of a state being crimped onto the end portion of the wire (W) covers from a portion on a front side from the front end (Wap1) of the conductor exposed section (Wap) to a portion on a rear side from a front end (Wb1) of a part of the cover (Wb), in which the connection structure further includes a waterproof sheet (30) that is disposed in an inner surface of the wire connection section (20) and has an opening section (34) in a position corresponding to the conductor exposed section (Wap), in which the waterproof sheet (30) is configured such that a front end (30*a*) of the waterproof sheet (30) is positioned on the front side from the front end (Wap1) of the conductor exposed section (Wap), in which a protruded strip (29) is formed in the conductor crimp section (21) along an inner peripheral surface having a U shape; and in which the wire connection section (20) of a state being crimped onto the end portion of the wire (W) is configured such that the protruded strip (29) is positioned between the front end (30*a*) of the waterproof sheet (30) and the front end (Wap1) of the conductor exposed section (Wap), the conductor crimp section (21) and the conductor exposed section (Wap) are electrically connected to each other through the opening section (34) formed in the waterproof sheet (30), and front and rear portions of a connection portion between the conductor crimp section (21) and the conductor exposed section (Wap) are closed by the waterproof sheet (30).

[5] The connection structure of a crimp terminal (10) with respect to a wire (W) according to [4], in which the waterproof sheet (30) is configured such that the front end (30*a*) of the waterproof sheet (30) is positioned on the front side from the front end (20*a*) of the conductor crimp section (21) and the rear end (30*b*) of the waterproof sheet (30) is positioned on the rear side from the rear end (30*b*) of the cover crimp section (22).

[6] The connection structure of a crimp terminal (10) with respect to a wire (W) according to [4], in which the protruded strip (29) is positioned on a rear end side from the front end of the conductor crimp section (21).

[7] A connection structure of a crimp terminal (10) with respect to a wire (W) including:

the wire (W) that has a conductor (Wa) and a cover (Wb) that covers the conductor (Wa); and a crimp terminal (10) of which an electrical connection section (11) that is electrically connected to a counterpart terminal is formed in a front portion and a wire connection section (20) that is crimped onto an end portion of the wire (W) is formed in a rear portion;

in which the wire connection section (20) has a conductor crimp section (21) that is crimped onto a conductor exposed section (Wap) in which a conductor (Wa) is exposed by removing the cover (Wb) of the end portion of the wire (W) and a cover crimp section (22) that is crimped onto a part of the cover (Wb) remained in the end portion of the wire (W), and the conductor crimp section (21) is formed on the front side and the cover crimp section (22) is formed on the rear side, in which the wire connection section (20) of a state being crimped onto the end portion of the wire (W) covers from a portion on a front side from the front end (Wap1) of the conductor exposed section (Wap) to a portion on a rear side from a front end (Wb1) of a part of the cover (Wb), in which the connection structure further includes a waterproof sheet (30) that is disposed in an inner surface of the wire connection section (20) and has an opening section (34) in a position corresponding to the conductor exposed section (Wap), in which the waterproof sheet (30) is configured such that a front end (30*a*) of the waterproof sheet (30) is positioned on the front side from the front end (Wap1) of the conductor exposed section (Wap), in which a confirmation window (28, 28B) is provided in the wire connection section (20) for visibly confirming the waterproof sheet (30) positioned inside thereof from outside of the wire connection section (20), and in which the wire connection section (20) of a state being crimped onto the end portion of the wire (W) is configured such that the conductor crimp section (21) and the conductor exposed section (Wap) are electrically connected to each other through the opening section (34) formed in the waterproof sheet (30), and front and rear portions of a connection portion between the conductor crimp section (21) and the conductor exposed section (Wap) are closed by the waterproof sheet (30).

[8] The connection structure of a crimp terminal (10) with respect to a wire (W) according to [7], in which the confirmation window (28, 28B) is provided in a position corresponding to the rear end of the conductor exposed section (Wap) in the wire connection section (20).

The present invention is useful for providing a connection structure of a crimp terminal with respect to wire capable of ensuring a reliable waterproof performance without applying extra man-hours

What is claimed is:

1. A connection structure of a crimp terminal with respect to a wire including:

the wire that has a conductor and a cover that covers the conductor; and a crimp terminal of which an electrical connection section that is electrically connected to a counterpart terminal is formed in a front portion and a wire connection section that is crimped onto an end portion of the wire is formed in a rear portion, in which the wire connection section has a conductor crimp section that is crimped onto a conductor exposed section in which a conductor is exposed by removing the cover of the end portion of the wire and a cover crimp section that is crimped onto a part of the cover remained in the end portion of the wire, and the conductor crimp section is formed on the front side and the cover crimp section is formed on the rear side, in which the wire connection section of a state being crimped onto the end portion of the wire covers from a portion on a front side from the front end of the conductor exposed section to a portion on a rear side from a front end of a part of the cover, in which the connection structure further includes a waterproof sheet that is disposed in an inner surface of the wire connection section and has an opening section in a position corresponding to the conductor exposed section, in which the wire connection section of a state being crimped onto the end portion of the wire is configured such that the conductor crimp section and the conductor exposed section are electrically connected to each other through the opening section formed in the waterproof sheet, the front end of the waterproof sheet protrudes from a front end of the conductor crimp section to an outside of the conductor crimp section, and front and rear portions of a connection portion between the conductor crimp section and the conductor exposed section are closed by the waterproof sheet.

2. The connection structure of a crimp terminal with respect to a wire according to claim 1, in which the waterproof sheet is attached to the inner surface of the wire connection section by an adhesive layer provided on a surface of a base sheet.

3. The connection structure of a crimp terminal with respect to a wire according to claim 1, in which an adhesive layer is provided in a surface with which the wire comes into contact in the waterproof sheet.

4. The connection structure of a crimp terminal with respect to a wire according to claim 1, in which a rear end of the waterproof sheet protrudes from a rear end of the conductor crimp section.

5. A connection structure of a crimp terminal with respect to a wire including:

the wire that has a conductor and a cover that covers the conductor; and a crimp terminal of which an electrical connection section that is electrically connected to a counterpart terminal is formed in a front portion and a wire connection section that is crimped onto an end portion of the wire is formed in a rear portion, in which the wire connection section has a conductor crimp section that is crimped onto a conductor exposed section in which a conductor is exposed by removing the cover of the end portion of the wire and a cover crimp section that is crimped onto a part of the cover remained in the end portion of the wire, and the conductor crimp section is formed on the front side and the cover crimp section is formed on the rear side, in which the wire connection section of a state being crimped onto the end portion of the wire covers from a portion on a front side from the front end of the conductor exposed section to a portion on a rear side from a front end of a part of the cover, in which the connection structure further includes a waterproof sheet that is disposed in an inner surface of the wire connection section and has an opening section in a position corresponding to the conductor exposed section, in which the waterproof sheet is configured such that a front end of the waterproof sheet is positioned on the front side from the front end of the conductor exposed section, in which a protruded strip is formed in the conductor crimp section along an inner peripheral surface having a U shape; and in which the wire connection section of a state being crimped onto the end portion of the wire is configured such that the protruded strip is positioned between the front end of the waterproof sheet and the front end of the conductor exposed section, the conductor crimp section and the conductor exposed section are electrically connected to each other through the opening section formed in the waterproof sheet, and front and rear portions of a connection portion between the conductor crimp section and the conductor exposed section are closed by the waterproof sheet.

6. The connection structure of a crimp terminal with respect to a wire according to claim 5, in which the waterproof sheet is configured such that the front end of the waterproof sheet is positioned on the front side from the front end of the conductor crimp section and the rear end of the waterproof sheet is positioned on the rear side from the rear end of the cover crimp section.

7. The connection structure of a crimp terminal with respect to a wire according to claim 5, in which the protruded strip is positioned on a rear end side from the front end of the conductor crimp section.

8. A connection structure of a crimp terminal with respect to a wire including:

the wire that has a conductor and a cover that covers the conductor; and a crimp terminal of which an electrical connection section that is electrically connected to a counterpart terminal is formed in a front portion and a wire connection section that is crimped onto an end portion of the wire is formed in a rear portion, in which the wire connection section has a conductor crimp section that is crimped onto a conductor exposed section in which a conductor is exposed by removing the cover of the end portion of the wire and a cover crimp section that is crimped onto a part of the cover remained in the end portion of the wire, and the conductor crimp section is formed on the front side and the cover crimp section is formed on the rear side, in which the wire connection section of a state being crimped onto the end portion of the wire covers from a portion on a front side from the front end of the conductor exposed section to a portion on a rear side from a front end of a part of the cover, in which the connection structure further includes a waterproof sheet that is disposed in an inner surface of the wire connection section and has an opening section in a position corresponding to the conductor exposed section, in which the waterproof sheet is configured such that a front end of the waterproof sheet is positioned on the front side from the front end of the conductor exposed section, in which a confirmation window is provided in the wire connection section for visibly confirming the waterproof sheet positioned inside thereof from outside of the wire connection section, and in which the wire connection section of a state being crimped onto the end portion of the wire is configured such that the conductor crimp section and the conductor exposed section are electrically connected to each other through the opening section formed in the waterproof sheet, and front and rear portions of a connection portion between the conductor crimp section and the conductor exposed section are closed by the waterproof sheet.

9. The connection structure of a crimp terminal with respect to a wire according to claim 8, in which the confirmation window is provided in a position corresponding to the rear end of the conductor exposed section in the wire connection section.

* * * * *